US010451345B2

(12) United States Patent
Gebhard et al.

(10) Patent No.: US 10,451,345 B2
(45) Date of Patent: Oct. 22, 2019

(54) HEATING DEVICE FOR ROTARY DRUM FREEZE-DRYER

(71) Applicant: Sanofi Pasteur SA, Lyons (FR)

(72) Inventors: Thomas Gebhard, Kandern (DE); Roland Kaiser, Efringen-Kirchen (DE); Matthias Plitzko, Neuenburg (DE); Manfred Struschka, Auggen (DE); Bernhard Luy, Freiburg (DE)

(73) Assignee: Sanofi Pasteur SA, Lyons (FR)

( * ) Notice: Subject to any disclaimer, the term of this patent is extended or adjusted under 35 U.S.C. 154(b) by 0 days.

(21) Appl. No.: 14/348,880

(22) PCT Filed: Oct. 4, 2012

(86) PCT No.: PCT/EP2012/004164
§ 371 (c)(1),
(2) Date: Mar. 31, 2014

(87) PCT Pub. No.: WO2013/050158
PCT Pub. Date: Apr. 11, 2013

(65) Prior Publication Data

US 2015/0007445 A1 Jan. 8, 2015

(30) Foreign Application Priority Data

Oct. 6, 2011 (EP) ..... 11008108

(51) Int. Cl.
*F26B 3/30* (2006.01)
*F26B 5/06* (2006.01)
*F26B 11/02* (2006.01)

(52) U.S. Cl.
CPC ..... *F26B 3/30* (2013.01); *F26B 5/06* (2013.01); *F26B 11/026* (2013.01)

(58) Field of Classification Search
CPC ..... F26B 3/30; F26B 11/026; F26B 11/028; F26B 11/02; F26B 11/0427; F26B 11/049;
(Continued)

(56) References Cited

U.S. PATENT DOCUMENTS 2,388,917 A 11/1945 Hormel
2,411,152 A * 11/1946 Folsom ..... F26B 5/06 34/92
(Continued)

FOREIGN PATENT DOCUMENTS

DE 196 54 134 C2 11/1997
DE 202005021235 U1 5/2007
(Continued)

OTHER PUBLICATIONS

"Flange" In The American Heritage Dictionary of the English Language. <http://search.credoreference.com/content/entry/hmdictenglang/flange/0>. Accessed Oct. 11, 2016.*
(Continued)

*Primary Examiner* — Jianying C Atkisson
*Assistant Examiner* — Tavia Sullens

(57) ABSTRACT

A heating device (124) for heating particles to be freeze-dried in a rotary drum (102) of a freeze-dryer (100) is provided, the device comprising at least one radiation emitter (202) for applying radiation heat to the particles, and a tube-shaped separator (204) for separating the particles from the at least one emitter (202). The separator (202) being integrally closed at one end and separating an emitter volume (206) encompassing the at least one emitter (202) from a drum process volume (126) inside the drum (102), wherein the heating device (124) protrudes into the drum
(Continued)

process volume (126) such that said integrally closed end of the separator (204) is arranged inside the drum (102) as a free end.

27 Claims, 9 Drawing Sheets

(58) Field of Classification Search
CPC ..... F26B 11/0495; F26B 5/06; F26B 5/04; F26B 5/10; F26B 23/10
USPC ..... 34/266, 108, 289; 373/109, 110, 111, 373/112, 115, 116, 117, 118, 119, 122, 373/125, 126, 127, 128, 129, 130, 131, 373/134; 219/411, 420, 421, 424, 427, 219/551, 552, 553
See application file for complete search history.

(56) References Cited

U.S. PATENT DOCUMENTS

| | | | | |
|---|---|---|---|---|
| 2,535,268 | A | 12/1950 | Coats | |
| 2,698,195 | A * | 12/1954 | Pollard, Jr. | F16J 15/38 277/385 |
| 3,308,552 | A * | 3/1967 | Kaufman et al. | 34/289 |
| 3,435,128 | A * | 3/1969 | Dorwald | H01B 17/308 174/151 |
| 4,101,424 | A | 7/1978 | Schooley et al. | |
| 4,114,903 | A * | 9/1978 | Bovio | F16J 15/348 277/321 |
| 4,251,680 | A * | 2/1981 | Germann | H01B 17/305 174/151 |
| 4,918,355 | A | 4/1990 | Morris et al. | |
| 5,537,925 | A * | 7/1996 | Secor et al. | 34/420 |
| 5,544,897 | A * | 8/1996 | Di Pietro | F16J 15/348 277/389 |
| 6,628,024 | B1 * | 9/2003 | Mirmobin | H01B 17/303 174/151 |
| 7,067,770 | B1 | 6/2006 | Volk et al. | |
| 2002/0148824 | A1 | 10/2002 | Hauf et al. | |
| 2009/0020518 | A1 * | 1/2009 | Ikeda | H05B 3/82 219/217 |
| 2009/0113751 | A1 * | 5/2009 | Teng et al. | 34/266 |
| 2014/0245629 | A1 | 4/2014 | Luy et al. | |
| 2014/0230266 | A1 | 8/2014 | Luy et al. | |
| 2014/0237846 | A1 | 8/2014 | Plitzko et al. | |
| 2014/0373383 | A1 | 12/2014 | Struschka et al. | |

FOREIGN PATENT DOCUMENTS

| | | | |
|---|---|---|---|
| JP | S 63-36828 | A | 2/1988 |
| JP | 2006-177640 | A | 7/2006 |
| WO | WO 2009/109550 | A1 | 9/2009 |
| WO | WO 2010/069438 | A1 | 6/2010 |
| WO | WO 2013/050156 | | 4/2013 |
| WO | WO 2013/050157 | | 4/2013 |
| WO | WO 2013/050161 | | 4/2013 |
| WO | WO 2013/050162 | | 4/2013 |

OTHER PUBLICATIONS

International Search Report and Written Opinion received in connection with international application No. PCT/EP2012/004164; dated Nov. 7, 2012.
Letter and Article 34 Amendments submitted in connection with international application No. PCT/EP2012/004164; dated Jul. 31, 2013.
Written Opinion of the International Preliminary Examining Authority received in connection with international application No. PCT/EP2012/004164; dated Oct. 17, 2013.
International Preliminary Report on Patentability dated Oct. 17, 2013 From the International Preliminary Examining Authority Re. Application No. PCT/EP2012/004164.

* cited by examiner

HEATING DEVICE FOR ROTARY DRUM FREEZE-DRYER

TECHNICAL FIELD

The invention relates to a heating device for heating particles to be freeze-dried in a drying device (e.g., a rotary drum) of a freeze-dryer or freeze-drying process line, to a separator thereof, as well as to a wall section of corresponding devices in a freeze-dryer or freeze drying process line.

BACKGROUND OF THE INVENTION

Freeze-drying, also known as lyophilization, is a process for drying high-quality products such as, for example, pharmaceuticals, biological materials such as proteins, enzymes, microorganisms, and in general any thermo- and/or hydrolysis-sensitive materials. Freeze-drying provides for the drying of the target product via sublimation of ice crystals into water vapor, i.e., via the direct transition of at least a portion of the water content of the product from the solid phase into the gas phase.

Freeze-drying processes in the pharmaceutical area can be employed, for example, for the drying of drugs, drug formulations, Active Pharmaceutical Ingredients ("APIs"), hormones, peptide-based hormones, carbohydrates, monoclonal antibodies, blood plasma products or derivatives thereof, immunological compositions including vaccines, therapeutics, other injectables and in general substances which otherwise would not be stable over a desired time span. In order that a product may be stored and shipped, the water (or other solvent) has to be removed prior to sealing the product in vials or containers for preservation of sterility and/or containment. In the case of pharmaceutical and biological products, the lyophilized product can be re-constituted later by dissolving the product in a suitable reconstituting medium (e.g., a pharmaceutical grade diluents) prior to, e.g., injection.

A freeze-dryer is generally understood as a process device which may, for example, be employed in a process line for the production of freeze-dried particles with sizes, for example, ranging from micrometers (μm) to millimeters (mm). Freeze-drying may be performed under arbitrary pressure conditions, e.g., atmospheric pressure conditions, but may also be efficiently performed (in terms of, for example, drying time scales) under vacuum conditions, i.e., defined low-pressure conditions, with which the skilled person is familiar.

Particles can be dried after filling into vials or containers. Generally, however, greater drying efficiency is achieved when particles are dried as bulkware, i.e., before any filling step. One approach for a bulkware freeze-dryer comprises employing a rotary drum for receiving the particles and keeping them under rotation during at least part of the freeze-drying process. The rotating drum mixes the bulk product which increases the effective surface area available for heat and mass transfer as compared to a drying the particles after they have been filled into vials or containers or as bulkware in stationary trays. Generally, bulk drum-based drying may efficiently lead to homogeneous drying conditions for the entire batch.

WO 2009/109 550 A1 describes a process for stabilizing a vaccine composition containing an adjuvant. The process comprises prilling and freezing of a formulation, and subsequent bulk freeze-drying and dry filling of the product into final recipients. The freeze-dryer may comprise pre-cooled trays which collect the frozen particles, and which are then loaded on pre-cooled shelves of the freeze-dryer. Once the freeze-dryer is cooled, a vacuum is pulled in the freeze-drying chamber to initiate sublimation of water from the pellets. Vacuum rotary drum drying is proposed as an alternative to tray-based freeze-drying.

Vapor sublimation can further be promoted by various measures intended to establish or maintain optimal process conditions such those concerning process pressure, temperature, humidity, etc., in the process volume. Optimum process temperature can be reached by cooling the process volume to about −40° C. to −60° C., for example. However, ongoing sublimation in the process volume tends to decrease the temperature further, which leads to a decrease in drying efficiency. Therefore the temperature has to be maintained within an optimum range during freeze-drying and a corresponding heating mechanism is required.

DE 196 54 134 C2 describes a device for freeze-drying products in a rotatable drum. The drum is filled with the bulk product. During freeze-drying, a vacuum is established inside the drum slowly rotating drum. The vapor released by sublimation from the product is drawn off the drum. The drum is heatable, specifically, the inner wall of the drum can be heated by a heating means provided outside the drum in an annular space between the drum and a chamber housing the drum. Cooling is achieved by inserting a cryogenic medium into the annular space.

Generally, drum wall mediated heat transfer has several disadvantages. For example, there is a tendency for particles to adhere (stick) to the inner surface of the drum, e.g., due to the high frozen water content at least at the beginning of the drying process and/or because of electrostatic interactions of particles with each other and/or with drum. Particles that stick to the drum wall take on the temperature of the inner wall. As a result, the maximum temperature of the heated wall is limited to a value where the product quality is not negatively affected, e.g., due to partial or total melting of the particles stuck thereto. Therefore, the stickiness or tackiness of the product has to be taken into account when designing a process line. This generally limits the proposition of heat transfer via the inner wall surface of a rotary drum and consequently lengthens the freeze-drying process since it is difficult to maintain the optimum drying temperature in the absence of other heating mechanisms.

Attempts have been to avoid the above-mentioned sticky particle effect. Designs have been proposed that seek to provide a heating source inside a rotating drum device. In one such design, U.S. Pat. No. 2,388,917 A or DE 20 2005 021 235 U1, an infrared (IR) radiation emitter is arranged inside the drum volume usually surrounded or at least partially covered by a protective shield means or the like. However, such a heating source can negatively affect product quality. For example, particles may fall off the rotating drum wall traverse the drum volume and by chance contact the operating heat emitter, despite various attempts to provide protective emitter shielding. Additionally, or alternatively, sublimation vapor drawn off the drum can carry particles through the process volume within the drum. A number of these particles once in flight can similarly come near enough to or actually contact the operating heat emitter. This can lead to a fraction of the product being partially or totally melted. As a further consequence, melted particles can stick to each other (agglomerate). As a still further consequence, melted particles can stick to the drum walls and/or emitter surface(s) etc. As a result, product quality can be negatively affected, and problems with operating the emitter can occur, and/or problems with subsequent cleaning and/or sterilization processes can occur. Furthermore, due to the different coefficients of thermal expansion inherent in the different construction materials typically used in the drums and emitter devices gaps can develop between components. This is particularly an issue when typical infrared emitters are used under vacuum process conditions inside the drum. Also, infrared heating sources are particularly difficult to clean or sterilize due to the mix of materials and the use of gaskets between components such as flanges and glass tubes.

SUMMARY OF THE INVENTION

In view of the above, one object underlying the present invention is to provide an improved heating device for a rotary drum based freeze-dryer; in particular, a heating device for a rotary drum based freeze-dryer is provided, that allows for efficient cleaning and/or sterilization, for example, allows the efficient implementation of Cleaning in Place ("CiP") and/or Sterilization in Place ("SiP") concepts, and which prevents any kind of leakage of the heating device. Thereby, it becomes possible to establish and/or maintain an optimum process temperature during freeze-drying more efficiently than is possible with conventional approaches. Moreover, with a heating device according to the present invention, a larger energy input during freeze-drying than conventional approaches can be achieved, as well as shorter drying times than are presently obtainable. Thereby, a high product quality without occurrence of partially or totally melted (molten) product can be ensured, and the applicability of rotary drum based freeze-drying can be increased.

According to one aspect of the invention, the object of the invention is achieved by providing a heating device for heating particles to be freeze-dried in a rotary drum of a freeze-dryer. The heating device according to the invention comprises at least one radiation emitter for applying radiation heat to the particles; and a tube-shaped separator for separating the particles from the at least one emitter, wherein the separator is integrally closed at one end and separates an emitter volume encompassing the at least one emitter from a drum process volume inside the drum. Here, the heating device is adapted to protrude into the drum process volume such that the integrally closed end of the separator is arranged inside the drum as a free end.

The particles may comprise granules or pellets, wherein the term "pellets" may refer to predominantly spheroidal or round particles, while the term "granules" may refer to predominantly irregularly formed particles. In particular embodiments, the particles to be freeze-dried comprise microparticles, such as micropellets or microgranules, i.e., particles with sizes in the micrometer range. According to one specific example, the particles to be freeze-dried comprise essentially round micropellets with a mean value for the diameters thereof selected from within the range of about 200 to 800 μm, preferably to 1500 μm, e.g., with a narrow particle size distribution of about ±50 μm around the selected value.

As generally used herein, the term "bulkware" refers to a system or aggregation of particles which contact each other, i.e., the system comprises multiple particles, microparticles, pellets and/or micropellets. For example, the term "bulkware" may refer to a lose amount of pellets constituting at least a part of a product flow, for example, a batch of a product to be freeze-dried in a freeze-dryer, wherein the bulkware is lose in the sense that it is not filled in vials, containers or other recipients for carrying or conveying the particles/pellets within the freeze-dryer. A similar definition holds true for use of the substantive or adjective "bulk". Consequently, bulkware as referred to herein will normally refer to a quantity of particles exceeding a single dose intended for a single patient. According to one example embodiment, a production run can comprise a production of bulkware sufficient to fill one or more Intermediate Bulk Containers ("IBCs").

Generally, a freeze-dryer is understood as a process device which provides a process volume, within which process conditions such as pressure, temperature, humidity (i.e., vapor-content, often water vapor, more generally vapor of any sublimating solvent), etc., can be controlled to achieve desired values for a freeze-drying process over a prescribed time span, e.g., a production run in a process line. The term "process conditions" is intended to refer to temperature, pressure, humidity, drum rotation, etc., in the process volume (preferably near to/in contact with the product), wherein a process control may comprise controlling or driving such process conditions inside the process volume according to a desired process regime, for example, according to a time sequence of a desired temperature profile and/or pressure profile. "Closed conditions", is to be understood as comprising sterile conditions and/or containment conditions, are also subject to process control, however, these conditions are occasionally discussed explicitly and separately from the other process conditions indicated above herein.

The freeze-dryer may be adapted to provide for an operation under closed conditions, i.e., sterility and/or containment. The terms "sterility" ("sterile conditions") and "containment" ("contained conditions") are to be understood as required by the applicable regulatory requirement for any specific case. For example, "sterility" and/or "containment" may be understood as defined according to Good Manufacturing Practice ("GMP") requirements. Generally, a production under sterile conditions may mean that no contamination (in particular preferably no microbial contamination) from an environment can reach the product. A production under containment may mean that neither of the product, elements thereof, excipients, etc., can leave the process volume and reach the environment.

A rotary drum for use with an embodiment of a heating device according to the invention may have any form or shape suitable for freeze-drying bulkware. As but one example, the rotary drum comprises a main section for carrying the particles that is terminated on both ends by terminating sections such as front and rear plates or flanges, for example. The main section may, for example, be cylindrical in shape, but may also have the form of a cone, multiple cones, etc. Embodiments of rotary drums can be axially symmetrical with reference to an axis of rotation and/or symmetry. However, deviations from pure symmetry can also be contemplated and can comprise, for example, a corrugated and/or ripped drum cross-section. Particular embodiments of the rotary drum can comprise openings in the front and/or rear plate for withdrawing sublimation vapor, communicating process conditions such as pressure and temperature between an interior and exterior process volume, etc.

Embodiments of freeze-dryers to support a freeze-drying of the bulk product in a drum can comprise: 1) a housing chamber for housing the drum; 2) a support for supporting a rotation of the drum, e.g., including a drive; and/or 3) equipment for establishing process conditions at least inside the drum such as cooling and heating equipment. The heating equipment comprises one or more embodiments of heating devices as described herein and/or as generally known.

In some embodiments, the rotary drum may be adapted for use within a housing chamber implemented as a vacuum chamber of the freeze-dryer. The vacuum chamber may comprise a confining wall which provides hermetic closure, i.e., hermetic separation or isolation of the confined process volume from an environment, thereby defining the process volume. The drum may be arranged entirely inside the process volume.

According to various embodiments, the drum is generally be open, i.e., one portion of the process volume internal to the drum may be in open communication with one portion of the process volume external to the drum. Process conditions such as pressure, temperature, and/or humidity will tend to equalize between the internal and external process volume portions. Therefore, the drum need not be limited to particular forms or shapes known for example for (excess) pressure vessels. For example, the front plate and/or rear plate may be of generally cone- or dome-like form, e.g., may be formed as a dished dome or cone, or may be of any other form appropriate for a particular application.

According to various embodiments, for example, the front plate comprises a charging opening for charging and optionally discharging the particles. Additionally, or alternatively, the rear plate may be involved in charging and/or discharging. In one example, charging or loading may be achieved via one or more openings in the front plate, and discharging or unloading may be achieved via one or more openings in the rear plate.

According to various embodiments, the radiation emitter comprises one or more radiating spirals or spiral coils (heating coils, heating spirals) protected within pipes such as single pipes, double pipes, etc. The emitter may be adapted for emitting radiation in an infrared range. For example, the wave length of emitted radiation may have a maximum in a micrometer range, such as selected from a range of about 0.5 μm to 3.0 μm, preferably about 0.7 μm to 2.7 μm, more preferably from about 1.0 μm to 2.0 μm. An emitter pipe may be partially covered with a reflecting means such as a gold coating applied section- or portionwise to the pipe. Such reflective means may be adapted to direct emitted radiation primarily into a particular angular range. For example, an emitter can be arranged to preferably emit radiation towards the product, such that less energy can be irradiated towards portions of the drum inner surface not covered by the product.

The radiation emitter can be controlled by external process control circuitry for controlling, for example, an operation of the freeze-dryer. For example, process control circuitry for driving a process may be adapted to control one or more heating means including one or more embodiments of a heating device as described herein. Process control may in particular comprise permanently controlling a power supply of the radiation emitter in response to detecting process conditions such as a temperature inside the process volume and/or the product, to optimize a temperature inside the process volume/of the particles. The emitter can be operated on demand, for example, if it is detected that a temperature in the process volume and/or of the product decreases below a threshold value, and/or if it is detected that a pressure in the process volume increases above a threshold value. This may result in the emitter being operated, for example, in irregular intervals. Embodiments of radiation emitters which are adapted for variable (dimmable) emission can be operated permanently during parts of the freeze-drying process, with varying emission intensity.

According to one example, a dimmable emitter will be switched on at a low intensity shortly after a start of a freeze-drying process, then the intensity (power) will increase in response to ongoing sublimation, and will reach a plateau or maximum value to be continued for longer timescales until the drying process is finished. Depending on the configuration of the freeze-dryer and the emitter, the maximum emission power can be given by the maximum power of the emitter (i.e., the drying timescales would be limited by the heat energy which can be provided by the emitter) or can be determined by other process parameters, such as the capability of removing the sublimation vapor from the process volume.

According to various embodiments, a heating device comprises one or more radiation emitters, wherein at least one of the one or more emitters have a single operation modus ("power on"), or its emission power can be continuously adjustable, with a maximum power of about 100 Watt (W), or 300 W, or 500 W, or 1.000 W, or 1.500 W, or 3.000 W, or more. According to one specific embodiment, a heating device comprises a single emitter with maximum power of 1.500 Watt (W). For a given freeze-dryer employing the heating device as the only heating source during lyophilization, a batch of bulk product may need a drying time of 6 hours. In other embodiments, longer and short drying time periods are also specifically contemplated. Typically, the emitter will be switched on by process control circuitry about 5 minutes after start of the lyophilization with a small emission power of 150 W. The emission power will then continuously increase until, about 1 hour after the start of the process, when a maximum power of about 1.500 W is reached. The emitter can continue to emit with full power (and/or intermittent power) for the remaining (5) hours until the end of the process.

According to various embodiments of the heating device according to the invention, the separator can be at least in part transmissive for the emitter radiation to enter the drum process volume. For example, the separator may comprise transmissive materials such as glass, quartz glass, silica glass, glass-ceramics, and the like. While other transparent materials can also be used, glass may be preferred for example because it can contribute to mechanical stability of the heating device and/or it can be resistant to high temperatures occurring with an operation of the radiation emitter. Additionally, or alternatively, a glass or glass-type material can offer benefits over, for example, mesh-like or fabric-type materials with regard to cleaning and/or sterilization.

According to particular embodiments of the invention, the separator separates the emitter volume from the process volume inside the drum. "Separating" is understood herein as isolating, excluding, or segregating the emitter volume from or out of the drum process volume. According to one specific exemplary embodiment, the separator comprises a tube which is adapted to accept or receive the emitter and isolates, excludes or segregates the emitter in the emitter volume formed by the tube from the process volume inside the drum.

According to various embodiments of the invention, the emitter volume may be elongated, for example, as required in order to receive one or more elongated, e.g., tube-shaped, emitters. The elongated emitter volume can be closed on at least one end. For example, the separator may comprise a tube protruding from a front or rear plate of the drum into the drum process volume. Such tube may be entirely closed to the inside of the drum, i.e., the drum process volume, but may or may not open to an exterior of the drum. Various embodiments of the invention are contemplated wherein the emitter volume is closed with respect to the drum process volume, but is open towards an exterior of the drum. For example, an elongated emitter volume, e.g., formed by a tube-shaped separator as an explanatory example, can connect to both front and rear plates or flanges of a drum and can open therethrough to an exterior of the drum on both sides thereof.

According to other embodiments, the emitter volume can be closed with regard to an interior of the drum and/or an exterior of the drum. According to particular embodiments, the emitter volume can be hermetically separated from the drum process volume, such that neither particles, nor other solid, liquid, or gaseous matter may enter the drum process volume from the emitter volume and/or enter the emitter volume from the drum process volume. It is to be noted that "separating" the emitter volume and drum process volume from each other does not necessarily imply "hermetically separating". For example, the emitter volume can be separated from the process volume by a mesh, a fabric, or like structure which may reliably separate the particles from the emitter, but allow passage of other matter.

It has to be noted, however, that mesh- or fabric-like structures, such as woven structures, even if they can withstand high emitter temperatures, can pose problems with regard to a cleaning of the separator and/or the radiation emitter. A cleaning medium, any pollutants, as well as steam sterilization condensates, and the like have to reliably pass through the mesh/fabric openings (in one or both directions), which can be difficult as these openings have to be small enough to keep (micrometer-sized) particles in the drum process volume.

Embodiments of plainly closed separator components, i.e., without a mesh-like structure or texture, such as components made from glass, for example, can separate or exclude not only the particles, but also other solid, liquid and/or gaseous matter from the emitter, such as, for example, a cleaning medium, sterilization medium, etc. In case the emitter volume is hermetically separated from the drum process volume, it is additionally implied that closed conditions (sterility conditions and/or containment conditions) can be established and maintained in the drum process volume, while the emitter volume can be entirely decoupled from such conditions. For example, while in the drum process volume vacuum conditions can be applied during freeze-drying and/or excess pressure conditions can be applied during cleaning/sterilization, atmospheric conditions can be applied in the emitter volume. Consequently, according to specific embodiments, the hermetic separation can contribute to preserving sterility in the process volume, wherein the process volume comprises the drum process volume and can comprise further process volume portions exterior to the drum.

The hermetic separation can be provided for at least one of vacuum pressure conditions and excess pressure conditions in the drum process volume. In particular in this respect, the separator has to be designed accordingly with sufficient mechanical stability. This may relate to wall thicknesses of separator components such as tubes, panels, slices, or similar transmissive sections and/or to the selection of construction materials. In cases where the emitter volume is said to be "closed", this is intended to mean that the separator encloses the emitter on all sides. In cases where the emitter volume is entirely decoupled by hermetic separation from the (drum) process volume, not only pressure conditions, but also temperature conditions (and humidity conditions, etc.) can be controlled independently for the emitter volume and for the process volume. For example, independent emitter volume control can comprise cooling an atmosphere in the emitter volume in order to minimize transport of heat resulting from the operation of the emitter into the process volume.

The heating device may be connected to the drum, and may for example be mounted to one or both of the front and rear plates or flanges of the drum, for example in a concentric fashion, preferably in equal distance to the product, and/or multiple heating devices/separators may be mounted in a symmetric fashion around an axis of symmetry/rotation of the drum. According to other embodiments, the heating device is supported independently of the drum, for example such that a support for supporting a fixed or variable positioning of the heating device inside the drum process volume is provided. This may include a support provided in conjunction with a rotary support of the drum, wherein the heating device is adapted to be held rotatable inside the drum process volume. According to one embodiment, a support is mounted to, for example, a housing chamber housing the drum. A variable positioning of the heating device enables to position the device selectively to irradiate the product, which may include that the device has to be re-positioned according to a rotation direction of the drum, a rotation velocity, a product filling level, and the like.

According to various embodiments of the invention, the separator comprises a tube, in particular a glass tube. Glass, for example, quartz glass, silica glass and the like, has a high transmissivity, i.e., has a high transmission rate of the radiation of the emitter into the process volume, which can be of the order of more than 80%, preferably more than 90%, particularly preferably more than 95%. At the same time, glass can contribute to mechanical stability of the heating device, such that further structural components, such as, for example, supporting structures, mountings, carriers or sockets for the tube, can be saved and/or reduced.

It is to be noted that the materials the heating device is made of at least with regard to those parts facing the process volume (for example, the separator or components thereof) have to withstand the different process regimes which can be run in the process volume. For example, in case the heating device is permanently located inside the drum, e.g., separator materials have to withstand temperatures ranging from, for example, −60° C. during a freeze-drying to +125° C. during, e.g., steam sterilization. Glass or glass-type materials are in this respect preferred, for example, glass types with small or even vanishing thermal expansion coefficients are available as components for the separator to withstand temperature differences of the order of about 200 Kelvin.

With regard to pressure-related requirements, components of the heating device such as, for example, a separator forming a hermetically closed emitter volume, may have to withstand on the process volume side vacuum conditions during freeze-drying, which may imply pressures as low as about 10 millibar (mbar), or 1 mbar, or 500 microbar (μbar), or 1 μbar, and also may have to withstand excess pressures during, e.g., steam sterilization, which may imply pressures as high as about 2 bar, 3 bar, or 5 bar. No excess pressure may be required if, for example, sterilization is performed based on hydrogen peroxide instead of based on steam.

According to particular embodiments, the tube may be made entirely of a single material such as glass, which minimizes sealing requirements for sealing the emitter volume and the process volume against each other. In other embodiments, a tube or other separator component may be made from multiple materials. For example, a metal tube may comprise one or more windows made of a glass material. Sealing with appropriate sealing material may then be required at areas where the different materials are in contact, for example, in order to preserve closed conditions inside the drum process volume.

According to various embodiments, one or more sections of the separator tube may have a circular or oval cross-section or shape. Other embodiments and/or sections may have a different shape, such as, for example, a triangular, square, rectangular, etc., shape. The shape may additionally, or alternatively, comprise a piecewise curved perimeter. It is noted, however, that a (slightly) oval or circular tube shape provides for an optimized stability of the tube. Shapes differing substantially from a circular perimeter may require increased wall thickness for similar stability. In the case of a glass tube(s), increased wall thickness may negatively influence the transmission capabilities (transmissivity) of the tube and increase the total weight of the heating device.

A cross-section of the tube may show a circumferential variation in wall thickness. According to one exemplary embodiment, a glass tube has a larger thickness in an upper portion of the tube and a smaller thickness in a lower portion of the tube. This embodiment may provide mechanical stability and at the same time optimized transmission capabilities for radiation emitted downwards into the process volume, i.e., incident on the product.

In other embodiments, the heating device further comprises a cooling mechanism for cooling at least parts or components of the heating device and in particular for cooling a surface of the heating device facing the drum process volume. For example, a cooling mechanism can have the aim to cool a glass tube of the heating device such that during an operation of the emitter a surface of the tube facing the drum is kept at temperatures below, for example, a melting temperature of the particles to be freeze-dried or is kept at an average current temperature of the product in the drum, or is kept at an optimum temperature for the freeze-drying process. According to specific embodiments, a temperature of a surface of the heating device facing the drum process volume is controlled, based on the cooling mechanism, to be at +30° C., or +10° C., or −10° C., or −40° C., or −60° C. The surface facing the process volume may be cooled down to temperatures as required for the product (composition, melting temperature, etc.).

The cooling mechanism may comprise a cooling volume for through-conveying a cooling medium. The cooling volume may comprise a tube- or pipe-shaped portion of the heating device, more specifically the separator. For example, the cooling volume can comprise one or more cooling pipes extending through the emitter volume. In one embodiment, a first pipe is provided for conveying a cooling medium in a forward direction, and a second pipe is provided for conveying the cooling medium in a backward direction. Additionally, or alternatively, a U-shaped pipe can be provided in the emitter volume for cooling purposes.

In particular embodiments, the cooling volume can comprise the emitter volume. For example, in case the separator comprises a tube for receiving or encompassing the emitter, the interior of the tube may at the same time be used for removing the operational heat of the emitter and thereby cooling the emitter and the tube.

According to various embodiments, the separator can comprise in addition to the emitter volume an isolation volume for isolating the emitter volume and the drum process volume from each other. According to various embodiments, an isolation volume can provide for passive isolation. In a specific embodiment, a passive isolation volume comprises a closed volume which is evacuated in order to provide the required isolating properties. According to other embodiments, an isolation volume can provide for active isolation. Exemplary embodiments in this respect comprise volumes devoid of any emitter, and subjected to active cooling by means of a cooling medium, i.e., an active isolation volume can be considered a cooling volume not including an emitter.

According to various embodiments, the heating device comprises a deflection means provided inside the separator for directing the radiation heat generated by the emitter. The deflection means can be provided, for example, in the shape of a roof-like structure with heat-resistant properties, thereby reflecting the heat generated by the emitter, preferably in a direction towards the material to be freeze-dried. Here, the deflection means is at least partly covering the emitter or the multiple emitters. For example, two emitters can be provided inside the separator, at best in an adjacent arrangement, thereby providing a more unified heat generating source. Preferably, the two emitters are provided in the form of a mirror-symmetric arrangement, i.e. an arrangement in which each emitter is a mirror image of the other emitter. In order to deflect heat in a sufficient manner in the case of such an arrangement of two emitters, it is preferable that each flank of the roof-like deflection means is arranged parallel to its opposing emitter, the two flanks of the deflection means and the two emitters thereby substantially forming a rectangular arrangement.

According to particular embodiments, the separator comprises a tube including two (or more) sub-tubes extending at least section-wise in parallel along the length of the tube. In one specific embodiment, a tube is separated along its length by an inner subdividing wall into an upper sub-volume or sub-tube and a lower sub-volume or sub-tube, wherein the emitter can be accepted, for example, in the lower sub-volume. A cooling medium can be conveyed, for example, into a forward direction in the lower sub-volume and in a backward direction in the upper sub-volume (i.e., both volumes are "cooling volumes"). In another embodiment, or a different operational mode, a cooling medium is conveyed only via the lower sub-volume, while no cooling medium flows through the upper sub-volume and no other active cooling mechanism is applied to the upper sub-volume. The upper sub-volume may be at atmospheric pressure, or may be evacuated or under low pressure conditions for achieving better isolation capabilities (i.e., the lower sub-volume functions as a "cooling volume" and the upper sub-volume functions as an 'isolation volume').

In still other embodiments, an inner tube can be encompassed, at least partially, by an outer tube. For example, the emitter volume can be defined by the inner tube, i.e., the radiation emitter is received in the inner tube, while the isolation volume is defined as the space between the inner and outer tube. For example, the isolation volume can comprise an annular space in case of concentric inner and outer tubes. The isolation volume can be evacuated for isolating the process volume of the drum against the high operating temperatures of the radiation emitter. In one embodiment, a cooling medium is conveyed through the isolation volume.

Combinations of embodiments are contemplated. For example, an annular space between an inner and outer tube to function as an isolation volume can be sub-divided into an upper and a lower half, for example, wherein a cooling medium can be conveyed via the lower half into a forward direction and via the upper half into a backward direction.

According to other embodiments, a tube, e.g., a glass tube, can have a plurality of (capillary) tubes embedded within a tube wall, wherein a cooling medium is conveyed along one or more of the capillary tubes into a forward and/or backward direction for cooling the surface of the tube facing the process volume. The emitter volume in the interior of the glass tube may or may not be subject to an additional cooling mechanism. In particular embodiments, the additional cooling mechanism may be switched on or off preferably automatically in response to the detection corresponding cooling requirements.

According to various embodiments the cooling medium can comprise air, nitrogen, and/or in general any medium(s), which is/are preferably nonflammable in view of the potentially high temperatures of the emitter in operation. In case a cooling medium is not in direct contact with the emitter, e.g., is conveyed via a portion of the cooling volume distinct from the emitter volume, the requirement of non-flammable cooling medium can be less strict. Additionally, or alternatively, a liquid cooling medium could be considered, which can be conveyed via, for example, capillary tubes formed by or in association with the cooling volume.

According to various embodiments of the invention, the heating device may further comprise one or more covering means for covering the emitter volume at least in part on the top. The covering means may function to deflect particles traversing the process volume substantially from top to bottom and may in this way prevent falling particles from coming near to the separator or contacting the separator, for example a glass tube thereof. According to particular embodiments, the covering means can comprise at least one of, for example, a single pitch roof, a double pitch roof, or an arched roof. The covering means can be spaced apart from other parts of the heating device, in particular the separator, or can be in direct contact therewith.

According to various embodiments, the heating device may also comprise a cooling mechanism for cooling the covering means, for example, for cooling in particular an upper surface of the roof prone to contact with particles. For example, a capillary piping or tubing system may be provided within roof-shaped structures of the covering means for conveying a cooling medium therethrough (for removing operational heat of the below emitter).

In particular embodiments, the heating device comprises at least one sensing means for sensing the drum process volume, for example, during freeze-drying, cleaning, etc. The sensing means may comprise one or more temperature sensors, pressure sensors, humidity sensors, etc. Contact-free sensors may also be provided. The sensor means may also include one or more cameras for achieving video/visual impressions of the inner drum and/or the product. Active and/or passive sensors operating based on, for example, optical, infrared, and/or ultraviolet radiation, and/or laser radiation, may also be arranged inside the emitter volume as long as the separator is transmissive for the corresponding radiation.

According to various embodiments, the heating device comprises cleaning/sterilization equipment for a cleaning/sterilization of the inner drum. The cleaning/sterilization equipment may comprise cleaning/sterilization medium access points such as nozzles, for example. The access points may be provided for supply of steam (steam sterilization) and/or (preferably gaseous) hydrogen peroxide for sterilization purposes. The access points may be provided for cleaning/sterilizing the heating device itself, for example, any surface of the separator facing the drum process volume, and/or may be provided for cleaning/sterilization of the inner drum (surface). The sensing means and/or the cleaning/sterilization equipment can be provided at least in part in association with the heating device, for example a covering means thereof.

According to some embodiments, the heating device can be adapted for CiP and/or SiP. For example, a surface of the heating device facing the drum process volume can be adapted accordingly. This may comprise minimizing edges, rips, angled structures, and in general structures which can be difficult to reach for cleaning/sterilization mediums and/or which hinder draining or outflow of the cleaning medium or of condensates resulting from steam sterilization, for example.

According to particular embodiments, the covering means is preferably adapted for easy cleaning/sterilization, which may include avoiding structures where particles would stick or collect at or otherwise be captured by the covering means, and/or may include avoiding structures difficult to reach by a cleaning and/or sterilization medium. Generally, a covering means may be preferable if it can be easily washed by cleaning/sterilization mediums; for example, a single pitch roof may be preferred over a double-pitch roof depending on the number and location of cleaning/sterilization medium access points.

According to another aspect to the invention, one or more of the above-indicated objects are achieved by a separator for separating particles to be freeze-dried in a rotary drum of a freeze-dryer from at least one radiation emitter for applying radiation heat to the particles. The separator is integrally closed at one end and forms an emitter volume for encompassing the emitter. The separator is adapted to separate the emitter volume from a drum process volume inside the drum, wherein the separator is adapted to protrude into the drum process volume such that said integrally closed end of the separator arranged inside the drum is a free end.

According to various embodiments, the separator comprises a glass tube with a circular cross-section. According to particular embodiments, each end of the glass tube can be closed by a flange. The flanges can be attached at the tube in order to provide a hermetic sealing of the drum process volume and the emitter volume inside the tube against each other. In some exemplary embodiments, a flange may be connected to the tube by means of a winding or thread on one or both of the glass tube and the flange. Additionally, or alternatively, a connection may be achieved by gluing the flange to the tube. According to a specific embodiment, which does not exclude other means of fixing the flanges with the tube, the separator comprises one or more rods extending inside the tube for pulling both flanges onto the tube ends.

According to various embodiments, the separator comprises at least one bar, for example a flat metallic (e.g., steel, stainless steel, aluminum, etc.) bar, extending inside the tube for supporting the emitter. One or more means for thermally decoupling the emitter and supporting bar can be provided. At least one of the flanges can comprise an inlet and/or an outlet for a cooling medium to be conveyed inside the tube. In order to provide the emitter with power, an electric power supply is provided. In particular, at least one of the flanges may be adapted for traversal of power supply into the emitter volume.

According to a still further aspect of the invention, one or more of the above objects is/are achieved by a wall section of a freeze-dryer for the bulkware production of freeze-dried particles. In particular embodiments, the freeze-dryer is a rotary drum based freeze-dryer. The wall section can, for example, comprise a front flange or front plate of a housing chamber of the freeze-dryer for housing the rotary drum. The housing chamber can be, for example, a vacuum chamber, wherein the drum is open to the vacuum chamber. In specific embodiments, the wall section can support a heating device for heating the particles to be freeze-dried in the rotary drum of the freeze-dryer, wherein the heating device may be any of the corresponding embodiments described herein.

According to another aspect of the invention, at least one of the above objects is achieved by a freeze-dryer comprising a wall section according to any of the corresponding embodiments described herein. The freeze-dryer can comprise a rotary drum, wherein an inner wall surface of the rotary drum is adapted for heating the particles to be freeze-dried. According to these embodiments, at least two heating mechanisms are provided during freeze-drying, namely a heating by the heating device supported by the wall section described herein and/or a heating via the inner wall surface of the rotary drum. In this respect, at least a part of the drum may comprise double walls.

Embodiments of the freeze-dryer contemplate employment of additional or alternative means for providing heat to the particles during a lyophilization process. According to particular embodiments, in addition to or as an alternative option, besides radiation heating and/or wall heating, microwave heating can be employed. One or more magnetrons can be provided for generating microwaves which are coupled into the drum preferably by means of waveguides such as, for example, one or more metal tubes. According to one particular embodiment, a magnetron is provided in association with a housing chamber of the freeze-dryer adapted to house the rotary drum (the housing chamber may, for example, be a vacuum chamber). A single waveguide can be provided for guiding the microwaves into the drum.

The waveguide can comprise a stationary metal tube with a diameter in the range of, for example, about 10 cm to 15 cm. Preferably, the waveguide enters the drum via an opening in the front plate (or rear plate) thereof, for example via a charging/loading opening. The waveguide may be positioned or positionable in the vacuum chamber or housing chamber with or without engagement with the drum.

According to various embodiments of the invention, a freeze-dryer can be adapted to provide multiple heating mechanisms and can, for example, comprise at least two of the following heating mechanisms: 1) a heating device including one or more radiation emitters as described herein; 2) one or more heatable inner walls of the drum and/or housing chamber for the drum; and 3) one or more of the aforementioned microwave heating devices. One or more of the multiple heating mechanisms can be employed per process as appropriate according to a specifically desired process regime.

Advantages of the Invention

Various embodiments of the present invention provide one or more of the advantages to be discussed herein. For example, according to embodiments of the present invention, a heating device is provided for heating particles to be freeze-dried in a rotary drum of a freeze-dryer, wherein the heating device comprises a radiation emitter applying radiation heat to the particles. The heating device enables transferring energy more efficiently to the particles as compared to conventional methods such as heating an inner surface of the drum (which mechanism nevertheless can additionally be employed or can be available as another heating option for particular process regimes).

Specifically, when heating an inner wall of the drum according to conventional techniques, an energy transfer from the wall to the particles is limited due to the tackiness of the particles. As the sticky particles may achieve the temperature of the wall, the maximum wall temperature is limited to the maximum allowable temperature for the particles while avoiding, for example, melting. As the energy transfer achievable in this way is lower than desirable for many process regimes (i.e., a higher energy transfer would be desirable), the drying times are correspondingly lengthened with correspondingly limited applicability of the freeze-drying process.

Inner wall heating can also be inefficient for another following reason. At any time only a small portion of the inner surface of the drum wall is in contact with the product. Thus, depending on filling level, i.e., batch size, the portion can amount to 25% of the surface of the main section of the drum, or can be much less, for example, only 10%. In other words, although each area of the drum wall surface is heated (other options not being practically feasible), substantial energy transfer occurs only during short time periods when the surface is in contact with the product. The situation is even worse for a system comprising predominantly spherical or spheroidal particles (pellets), which system comprises fewer contact points with the wall as compared to a system comprising mostly granules, flakes, or other particles with flat surfaces. As a result, the heat transfer coefficient for a particle system comprising mostly pellets is particularly low. Generally, the heating which is applied to the non-contact portions of the drum surface can at least not directly be transferred to the particles, i.e., the heat transfer cannot be focused towards the product, which further contributes to the inefficiency of this approach.

Employing a radiation emitter according to the invention can help removing at least the problem of tackiness. Even in cases where the emitter is permanently under operation, particles are not normally irradiated for longer times due to the rotation of the drum and the corresponding movement and continual mixing of the particles. According to particular embodiments, the emitter can be adapted by reflecting means and the like to irradiate preferably into one or more distinct areas of the drum and may (e.g., controllably) be configured to selectively irradiate those portions of the drum where the majority of the particles (the batch) is located.

Heat is primarily transferred to those particles momentarily forming the upper layer of the batch with reference to the emitter, wherein the upper layer is continually reconstituted due to drum rotation. Particles sticking to the wall may move into and out of a radiation area and are therefore also subject to limited heating only. Therefore with this heating method no particles are subject to excessive overheating (the problem of particles contacting the heating device is discussed below), i.e., the energy transfer is more evenly distributed over the particle system. As a result, more energy can be transferred to the product, which can shorten the drying times considerably. As one such example, for a conventional configuration using drum inner wall heating as the only heating mechanism during lyophilization, 12 hours of drying time were required. Providing a heating device with a radiation emitter according to the invention resulted in a drying time of only 6 hours, i.e., a reduction of 50%.

Without wishing to be bound to any particular theory or method of action, it is noted that a radiation emitter can be operated at a much greater temperature than is possible when applying inner drum wall heating, i.e., the radiation emitter provides for a much larger energy transfer potential.

Employing a radiation emitter according to the invention can additionally, or alternatively, help in removing the problem of unfocused energy transfer. The radiation of the emitter can be directed towards the product by a simple reflecting means such as a reflective coating and the like, which leads to a focused heat transfer with correspondingly higher energy transfer efficiencies. Moreover, the heat transfer is contemplated not to be dependent on particle shapes; therefore heat can be transferred efficiently to any particle system, including particle systems comprising, for example, predominantly round-shaped particles (e.g., pellets).

While one or more radiation emitters can be used to provide an optimized control of process temperature during freeze-drying, there is the problem of the high operating temperatures of the emitter(s). For example, operating temperatures of the emitter itself (atmospheric conditions) can be in the range of about between +250° C. to +400° C. or higher. Normally, operating temperatures are much higher than any temperature thresholds acceptable from the point of view of product quality. Limiting an operation of a radiation emitter in order to limit the maximum operation temperature is not a preferred solution, as then the heat transfer capabilities would be correspondingly limited.

According to embodiments of the invention, a heating device with a radiation emitter further comprises a separator for separating the particles inside the drum from the emitter. The separator forms an emitter volume for encompassing the emitter. The separator is adapted to separate the emitter volume from the (rest of the) drum process volume. "Separation" is to be understood as referring at least to the capability of keeping the particles to be freeze-dried away from the emitter (at least during an operation thereof). According to various embodiments of the invention, the separator is adapted to prevent the particles adversely experiencing or being overly affected by the operating temperature of the radiation emitter, at least insofar as the operating temperature is too high from the point of view of product quality.

The separator thus can provide for a separation, isolation, exclusion and/or segregation of the particles from the emitter (volume) by providing a corresponding barrier around the emitter, thereby forming the emitter volume. In preferred embodiments, the emitter temperature can be kept out of the process volume and/or is hidden in relation to the particles. According to various embodiments, the separator can be adapted to prevent any substantial heat/energy transfer from the emitter (emitter volume) towards the process volume, with the exception of the radiation emitted by the emitter. Preventing "any substantial" energy transfer in this respect means that the energy transfer is understood to mean that product quality is not deteriorated and/or product specifications are not deviated from or compromised.

According to various embodiments of the invention, the separator provides a barrier to prevent particle trajectories (or at least a desired fraction or portion thereof) from coming near to or even in contact with the emitter. For example, such trajectories may be deflected by a glass tube, and/or a covering means such as a roof, etc. As particles may traverse the drum volume during a freeze-drying process in virtually all directions and with complex trajectories, generally a simple blind or cover or shield will not suffice. According to preferred embodiments of the invention, the separator forms a particle barrier spanning over at least a substantial fraction of an imaginary surface completely enveloping the emitter, wherein the fraction comprises at least from about 50%, or 66%, or 75%, or more, of the enveloping surface, and preferably comprises from about 80%, or 90%, and more preferably comprises from about 95%, or 97%, or 99%, or 100% (i.e., the separator entirely encloses the radiation emitter without any opening towards the drum process volume).

Embodiments of the invention are contemplated that comprise a separator or a component thereof made of, for example, a mesh or fabric (e.g., a metal or textile material, as long as such material withstands conditions such as the operating temperature of the emitter as well as the process conditions during the freeze-drying process, cleaning/sterilization process, etc.). According to various embodiments, openings in the mesh or fabric are small enough to prevent at least particles above a predefined (desired) size from reaching the emitter volume. For example, a minimum size of particles can be set according to a wanted range of particle sizes in the end product and/or according to a tolerable fraction of product mass lost to the emitter volume, which can be calculated based on, for example, known particle sizes and size ranges in the batch to be freeze-dried.

In other embodiments, the separator comprises no mesh or fabric or similar components with "microscopic" openings comparable to particle sizes (e.g., openings in the millimeter or micrometer range), but comprises only components with a surface substantially impermeable for particles of any size, made of a material such as glass or other transparent materials. While such components are devoid of microscopic openings in the above sense, they can comprise "macroscopic" openings larger than the particle sizes (e.g., openings in the centimeter range), wherein these openings may open towards the interior of the drum, or the exterior of the drum. For example, a simple tube-shaped separator may open with on one or both of its ends towards the drum process volume or to an exterior of the drum.

Preferred embodiments of the invention with separator components comprising one or more macroscopic openings are, however, closed entirely with reference to the drum process volume and may only open to a volume external to the drum. For example, a tube-shaped (or cone-shaped, etc.) separator may have one end of its tube, cone, etc., protruding into the drum, this end being closed, while the other end is assembled, attached or mounted at the drum wall and opens towards an outside of the drum. Depending on the intended employment scenarios for the drum, an outside volume may comprise a process volume in connection with the interior of the drum.

For example, in one embodiment, the drum is housed inside a vacuum chamber adapted for providing or confining a process volume for the freeze-drying process, cleaning/sterilization process, etc. In this embodiment, no particles may enter the emitter volume directly from the inside of the drum. Particles may however leave the drum and may traverse the process volume portion exterior to the drum to reach the emitter volume. Depending on desired process regimes, the resulting degree of particle loss, potential pollution of the emitter, potential deterioration of product quality due to (partially) melted particles can be tolerated in view of other advantages such as increased stability of the separator, design simplicity, and the like.

According to preferred embodiments of the invention, the emitter volume is entirely closed (at least in the above-defined macroscopic sense, preferably also in the microscopic sense) with respect to the process volume, irrespective of whether the process volume is restricted to the interior of the drum or not. In other words, the emitter volume is entirely closed to the drum process volume and any further process volume portion which may be located outside the drum. For example, a tube-shaped or otherwise elongated emitter volume may protrude with one free end into the drum process volume, while another end is affixed, assembled or mounted to the drum or a support structure external to the drum. In still other embodiments, an entirely closed emitter volume is not in any sense connected (mounted, assembled or affixed) with any part of the drum such as drum wall, flange or plate section thereof, but is supported from an outside of the drum, for example is supported by a supporting arm extending from a housing chamber wall section into the drum.

In such configurations, the heating device can be permanently or temporarily located virtually anywhere inside the drum process volume. In cases where the heating device is movably mounted with respect to the drum interior, embodiments of the invention contemplate a process control including a positioning and directing of the heating device for achieving selective irradiation onto the specific product location(s) inside the drum during the freeze-drying process. This contributes to further optimizing the energy transfer, minimizing energy consumption and shortening drying times.

A "closed" emitter volume is considered closed with regard to the traversal of particles between the emitter volume and the process volume (drum). For a "hermetically closed" emitter volume, not only is the traversal of particles prevented, but no solid or gaseous or liquid matter may be exchanged between emitter volume and (drum) process volume. However, with regard to the emitter volume, the terms "closed" and "hermetically closed" do not exclude supply of power for the radiation emitter, supply and/or removal of a cooling medium, cleaning/sterilization mediums, etc.

Embodiments of the invention providing for hermetic separation between the drum process volume and the emitter volume enable separate control of, for example, thermodynamic conditions such as pressure and temperature in the drum process volume on the one hand and in the emitter volume (and/or an isolation volume) on the other hand. The thermodynamic conditions in the process volume are often referred to as "process conditions" herein. For example, a control of conditions inside the drum process volume may refer to control of process conditions as required for a freeze-drying process.

According to some embodiments, the conditions inside the emitter volume can comprise atmospheric pressure as opposed to, for example, vacuum conditions in the drum process volume during freeze-drying. Conditions in the emitter volume can further comprise defined temperature values, ranges or profiles, which are achieved by cooling the emitter volume. The cooling mechanism for the emitter volume can be entirely decoupled from any cooling or heating mechanism for the (drum) process volume. As a result, for example, an unsterile cooling medium can be used for cooling the emitter volume (and/or the isolation volume). Cooling can prevent the effects of any excess temperatures resulting from the operation of the emitter from reaching the drum process volume or the particles therein. In this way, for a surface of the separator or other components of the heating device which faces the drum process volume and which is potentially prone to particles coming near to or contacting the surface, a surface temperature can be controlled as required for any individual process regime, particle compositions, etc.

Consequently, various embodiments of the invention enable the minimization of potentially negative impacts which can result from high operating temperatures of emitters and therefore allow utilization of the potentially high energy input of radiation emitters, as required for freeze-drying processes with shorter drying times as presently available. In other words, according to embodiments of the invention, freeze-dryer embodiments/concepts are provided which minimize the potentially negative impacts of the high operating temperatures of radiation emitters, thereby substantially widening the applicability of radiation emitters in the field of freeze-drying, in particular, rotary drum based freeze-drying.

Embodiments of the invention provide for a considerable reduction of drying times as compared to conventional designs, for example, by a factor of about 10%, or 20%, or 25% or more, preferred by about 33% or more, particularly preferred by about 50% (half of the conventional drying time), or more. As one consequence, embodiments of the invention enable a reduction in energy consumption for the freeze-drying process. Shorter drying times, for example, lead to less energy consumption for maintaining, e.g., vacuum conditions in the process volume, or temperature conditions in the condenser, etc., during the process time.

According to various embodiments of the invention, for rotary drum based freeze-dryers including heating devices based on one or more radiation emitters, integrated design concepts including provisions for CiP/SiP can be provided. For example, separators providing for a hermetic separation between drum process volume and emitter volume can be designed to ensure a reliable protection of particles being negatively influenced by the emitter (for example, the separator can prevent a partial or total melting due to excessive heat transfer from the emitter). This contributes to ensuring high product quality, and, moreover, contamination/pollution of the drum process volume can also be minimized, which otherwise would result from, for example, partially or totally melted particles sticking to a drum inner wall surface and/or other equipment arranged in the drum process volume (e.g., sensing equipment, cameras, nozzles for cleaning/sterilization, and the like). In this respect, a pollution of the radiation emitter itself with partially or totally molten particles can also be avoided. Accordingly, in some embodiments there is no need for potentially complex cleaning/sterilization equipment or procedures (e.g., manual cleaning) in order to remove such pollution from the interior of the drum and/or the radiation emitter.

With a view to CiP/SiP, according to embodiments of the invention optimized concepts can be provided which comprise appropriate designs for the heating device, in particular the surfaces of the heating device facing the process volume. For example, tube-like structures for the separator or other components of the heating device can have a substantially "round" profile, while the tube itself can be a straight tube, but can also be of a U-type shape or of any other shapes with minimized surfaces potentially prone for accumulation of pollution, sticking of particles, etc. Generally, according to embodiments of the invention, heating device components such as separators can be provided with minimized edge areas, ridges or rim areas, and the like. According to one example embodiment, the separator can comprise substantially a single structure such as a straight glass tube (with one or two termination components such as flanges) without inlets, insets, recesses, edges, etc.

According to various embodiments of the invention, heating devices adapted, for example, for CiP/SiP can be permanently in place inside the drum, i.e., can be in place not only during freeze-drying, but also during cleaning/sterilization processes, etc. This can contribute to simplifying a freeze-dryer design. According to other embodiments, the heating device is arranged to be removable from the interior of the drum, for example, by means of a supporting pivot arm, rotary arm, and the like. According to particular embodiments, for example the separator can have forms or shapes optimized for CiP/SiP and for mechanical stability. For example, a separator comprising a glass tube with substantially circular cross-section, or a near-circular cross-sections such as a (preferably slightly) oval cross-section, can provide for optimized mechanical stability, while moreover minimizing required wall thicknesses for the tube, thereby further at the same time optimizing transmissivity (for the emitter radiation incident on the product) and weight (of the heating device, which requires support).

Embodiments according to the invention, which provide for a hermetic closure between (drum) process volume and emitter volume, can also avoid costly validations of the emitter volume according to regulatory requirements such as the GMP ("Good Manufacturing Practice"). The emitter itself, as well as any further equipment included within the emitter volume (or isolator volume) of the separator are excluded from the drum process volume and are therefore not subject of any validation requirements. This may relate to cooling equipment, any equipment for supporting the radiator, as well as contact-free sensing equipment such as temperature sensors, humidity sensors, optical sensors such as cameras, laser-based sensors and any active or passive sensor equipment, as long as the sensors can operate through the separator, e.g., transmissive portions thereof. Sensor operation may require transmissivity of the separator in different wavelength areas, for example, in the optical, infrared, ultraviolet, etc., quartz glass as a material for the separator may provide appropriate transmissivity in the required wavelengths.

As there are no requirements, such as sterility requirements, corresponding cleaning/sterilization requirements, and the like, for a hermetically separated emitter volume (isolation volume), provision of the above-discussed equipment therein can simplify the design and reduce costs. According to exemplary embodiments, arrangement of sensor equipment inside the emitter volume (or isolation volume) can reduce costs for contact-free sensor equipment. According to particular embodiments, a cooling mechanism for the emitter volume can make use of an unsterile cooling medium such as unsterile nitrogen or unsterile air, which considerably reduces costs as compared to using a sterile cooling medium such as sterile nitrogen or sterilized air. An air cooling according to some embodiments can be implemented as an open cooling system, further reducing costs.

SHORT DESCRIPTION OF THE FIGURES

Further aspects and advantages of the invention will become apparent from the following description of explanatory example and preferred embodiments as illustrated in the figures, in which.

Figure 6:
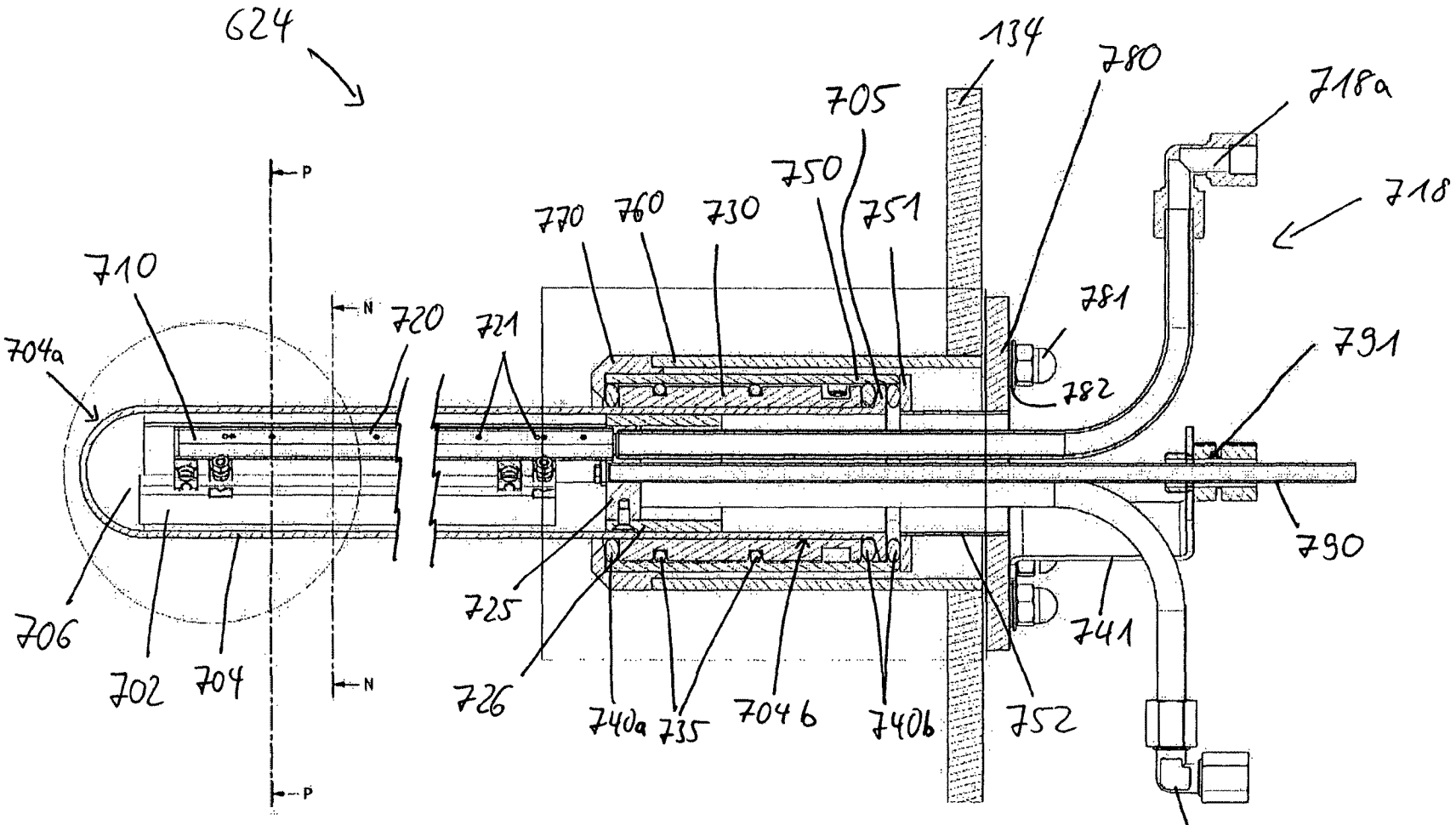
Figure 7A:
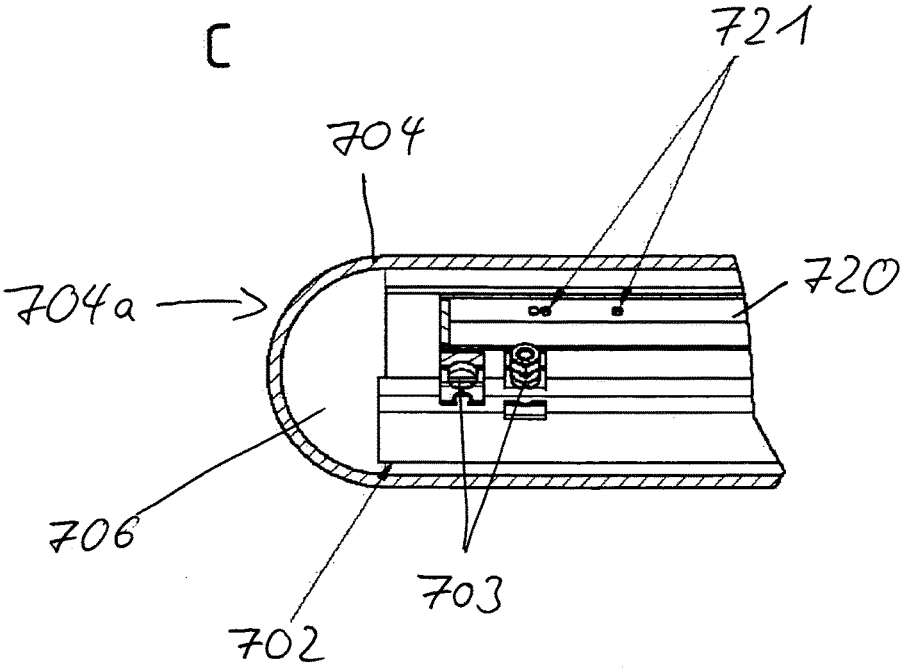
Figure 7B:
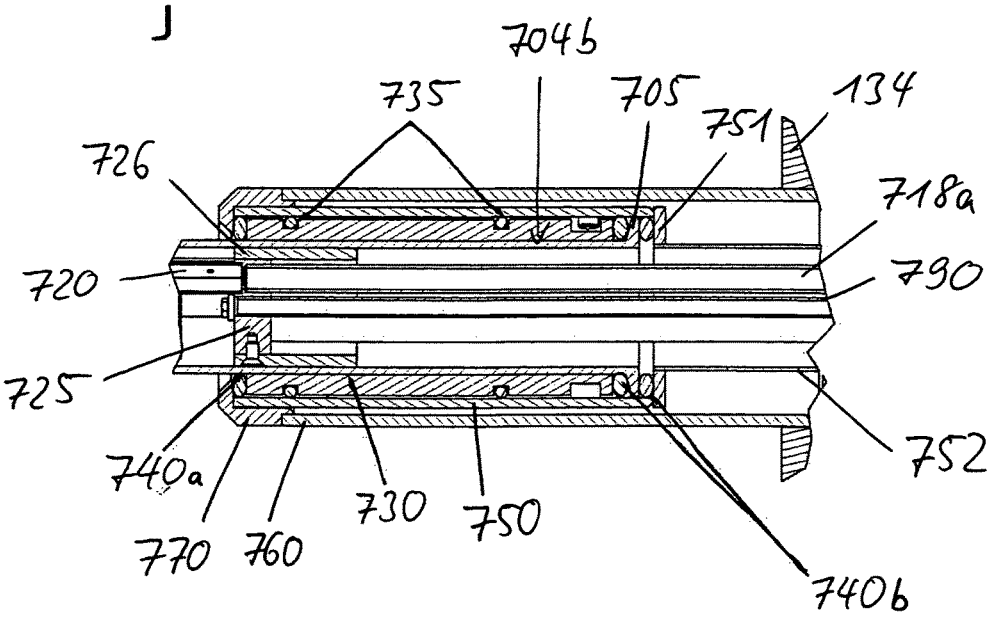
Figure 8A:
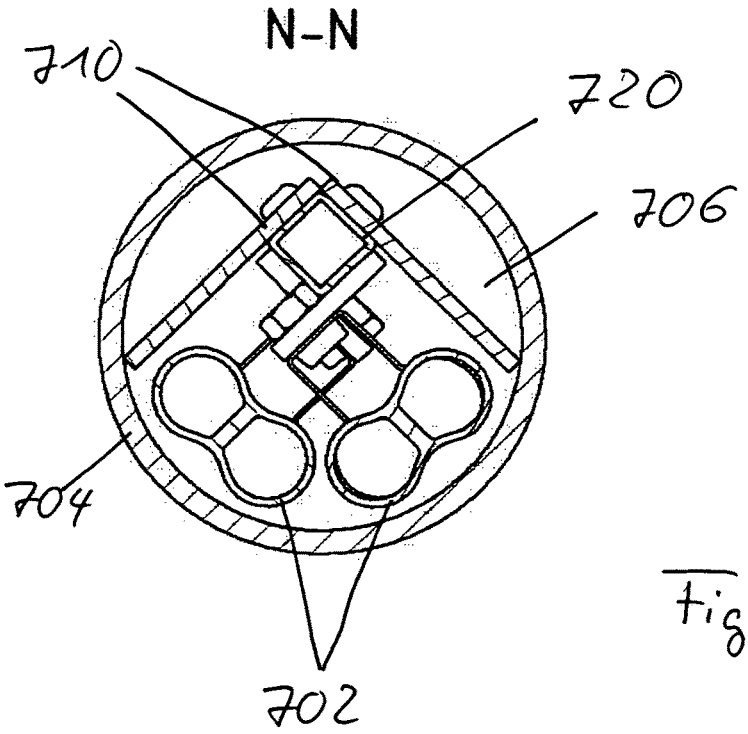
Figure 8B:
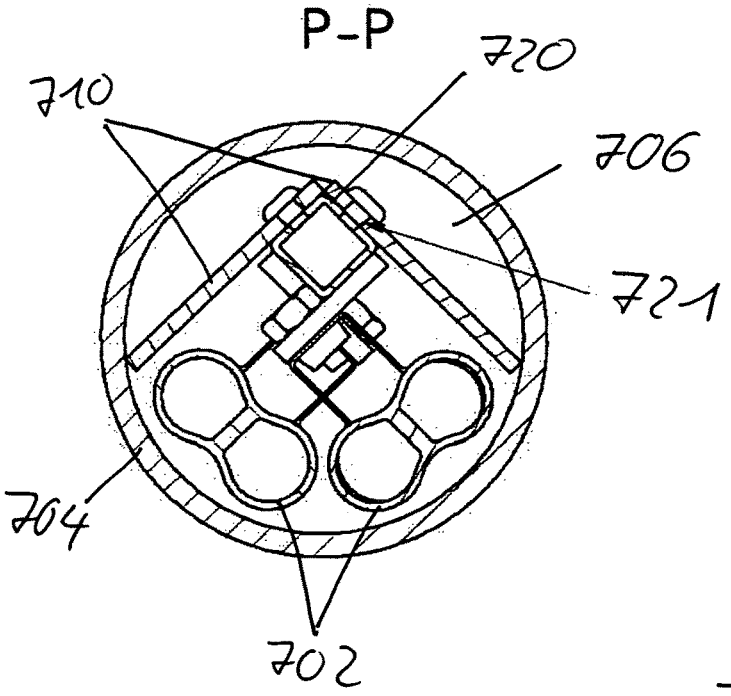
Figure 9A:
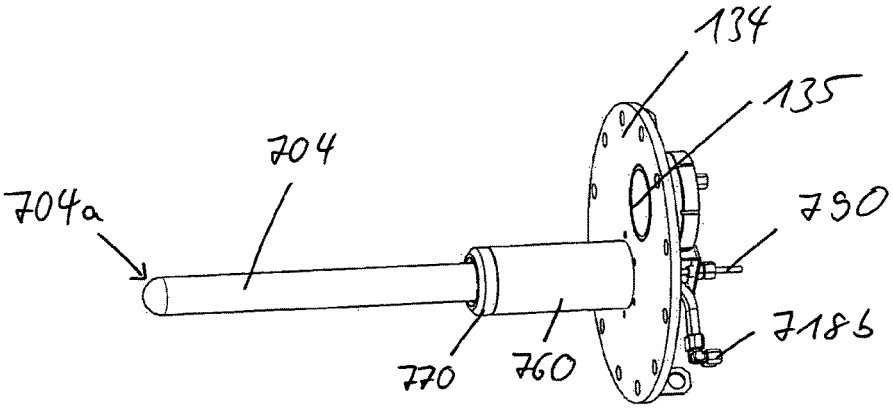
Figure 9B:
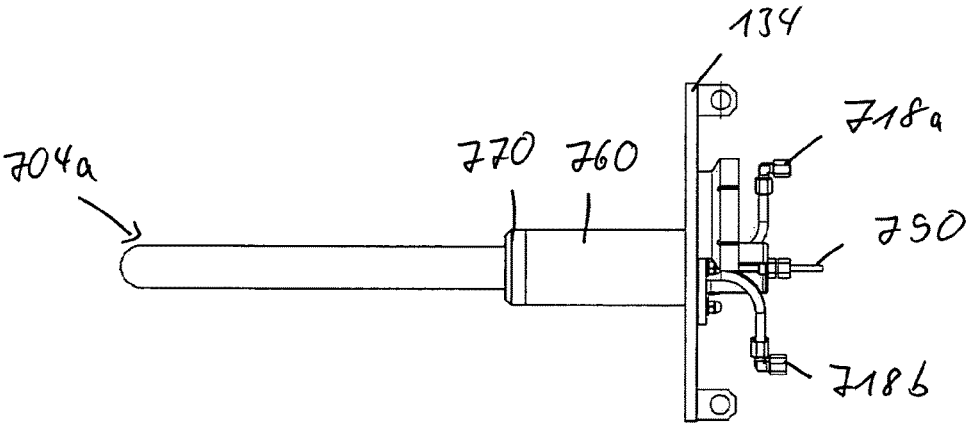

FIGS. 5A-D are cross-sectional views of various embodiments of separator components;

FIG. 6 is a cross-sectional illustration of a preferred embodiment of a rotary drum based freeze-dryer according to the invention;

FIG. 7A is an enlarged illustration of the area in FIG. 6 marked with C;

FIG. 7B is an enlarged illustration of the area in FIG. 6 marked with J;

FIG. 8A is an enlarged cross-sectional illustration of the heating device of FIG. 6 along line N-N;

FIG. 8B is an enlarged cross-sectional illustration of the heating device of FIG. 6 along line P-P;

FIG. 9A is a perspective view of the heating device of FIG. 6;

FIG. 9B is a side view of the heating device of FIG. 6; and

Figure 9C:
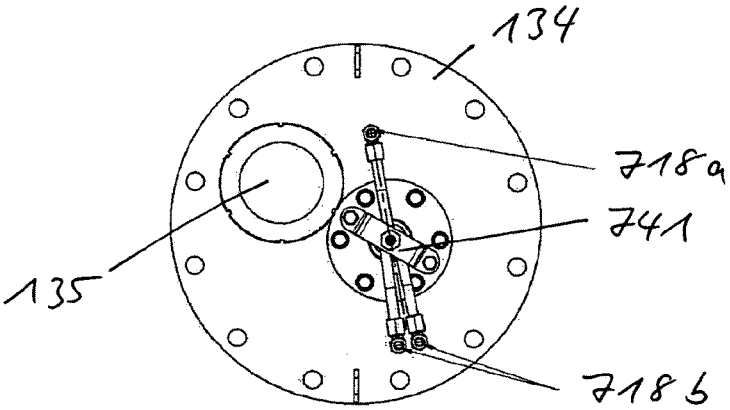

FIG. 9C is a plan view of the heating device of FIG. 6 from the left side in FIG. 6.

DETAILED DESCRIPTION OF EXPLANATORY EXAMPLES AND PREFERRED EMBODIMENTS

Figure 1:
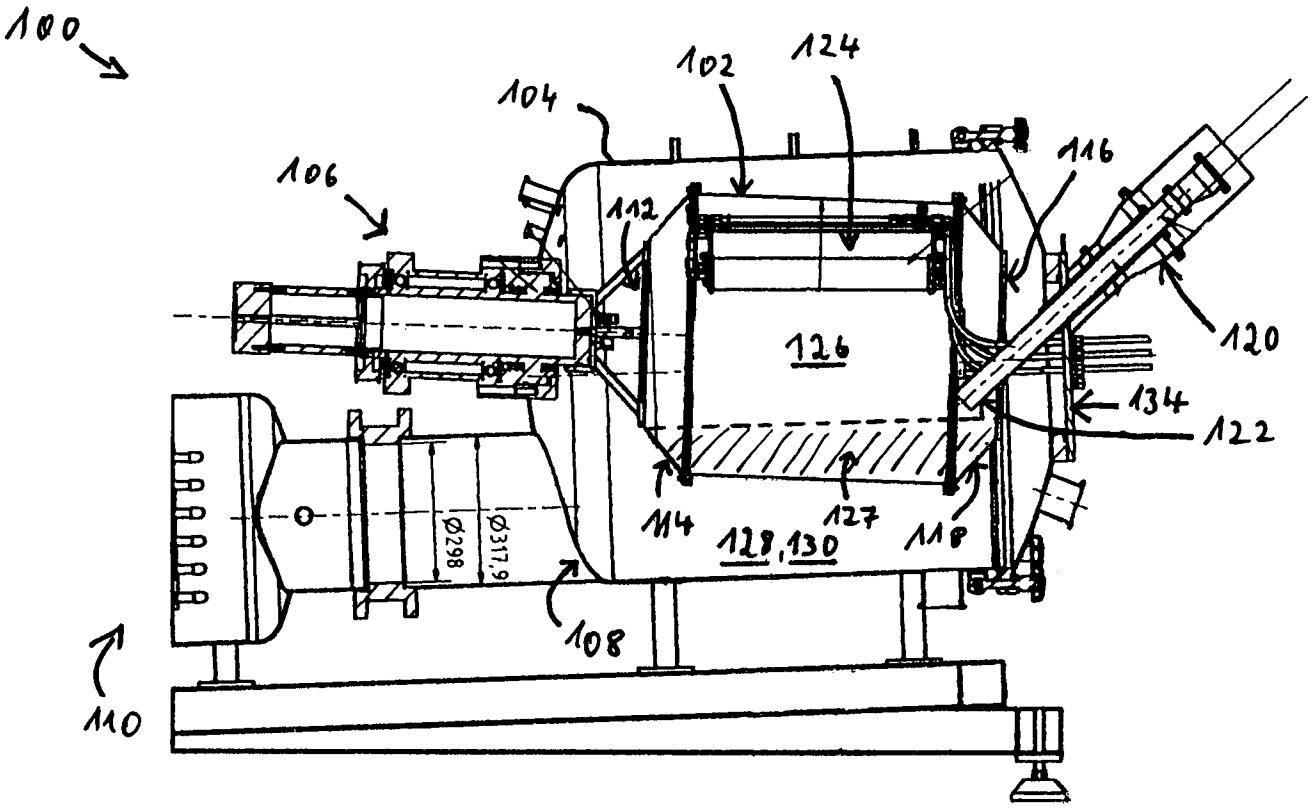
FIG. 1 is a cross-sectional illustration of an explanatory example of a rotary drum based freeze-dryer including a heating device.

FIG. 1 schematically illustrates in a cross-sectional view an explanatory example 100 of a freeze-dryer comprising a rotary drum 102 supported within a housing chamber 104 by a single rotary support 106. The housing chamber 104 is implemented as a vacuum chamber and connected via opening 108 with condenser and vacuum pump 110. The freeze-dryer 100 is adapted for freeze-drying particles such as microparticles, preferably micropellets, under closed conditions, i.e. under conditions of sterility and/or containment.

Drum 102 comprises an opening 112 on its rear plate 114 and an opening 116 on its front plate 118. Opening 116 is adapted for loading the drum 102 with particles via a transfer section 120 comprising an interior guiding tube 122 for guiding a product flow from an upstream particle storage/container and/or particle generation device (such as a spray chamber, prilling tower, and the like) into drum 102.

The drum 102 comprises a heating device 124 for heating a drum process volume 126 inside the drum and a particle system (batch) 127 loaded into drum 102 via tube 122 and carried by drum 102 during freeze-drying. It is to be noted that the process volume for establishing process conditions for freeze-drying is the entire interior 128 of vacuum chamber 104, which comprises the process volume portion (drum process volume) 126 inside the drum as well as a process volume portion 130 outside the drum.

A freeze-drying process can be initiated, for example, by cooling the process volume 128 to optimum temperatures for an efficient freeze-drying process, and in parallel or following thereto, establishing vacuum conditions and loading the particles 127 via guiding tube 122 into drum 102. Such cooling can be achieved by cooling equipment arranged in association with either drum 102 and/or vacuum chamber 104.

During freeze-drying, vacuum pump and condenser 110 operate to withdraw sublimation vapor from the drum process volume 126 via openings 112, 116. Due to the vapor sublimation, the temperature of the particles and in the process volume 128 decreases below optimum values. Process control drives the freeze-drying process according to an optimized process regime, which requires that heat has to be applied to the particles to maintain the optimum temperature level/range for lyophilization. Conventional mechanisms of applying heat comprise, amongst others, heating an inner wall surface of drum 102. While the explanatory example of the freeze-dryer 100 as illustrated in FIGS. 1 to 5D and described here is not intended to exclude utilization of such conventional methods, the following discussion focuses on the application of heat by the heating device 124 to the particles 132.

Figure 2:
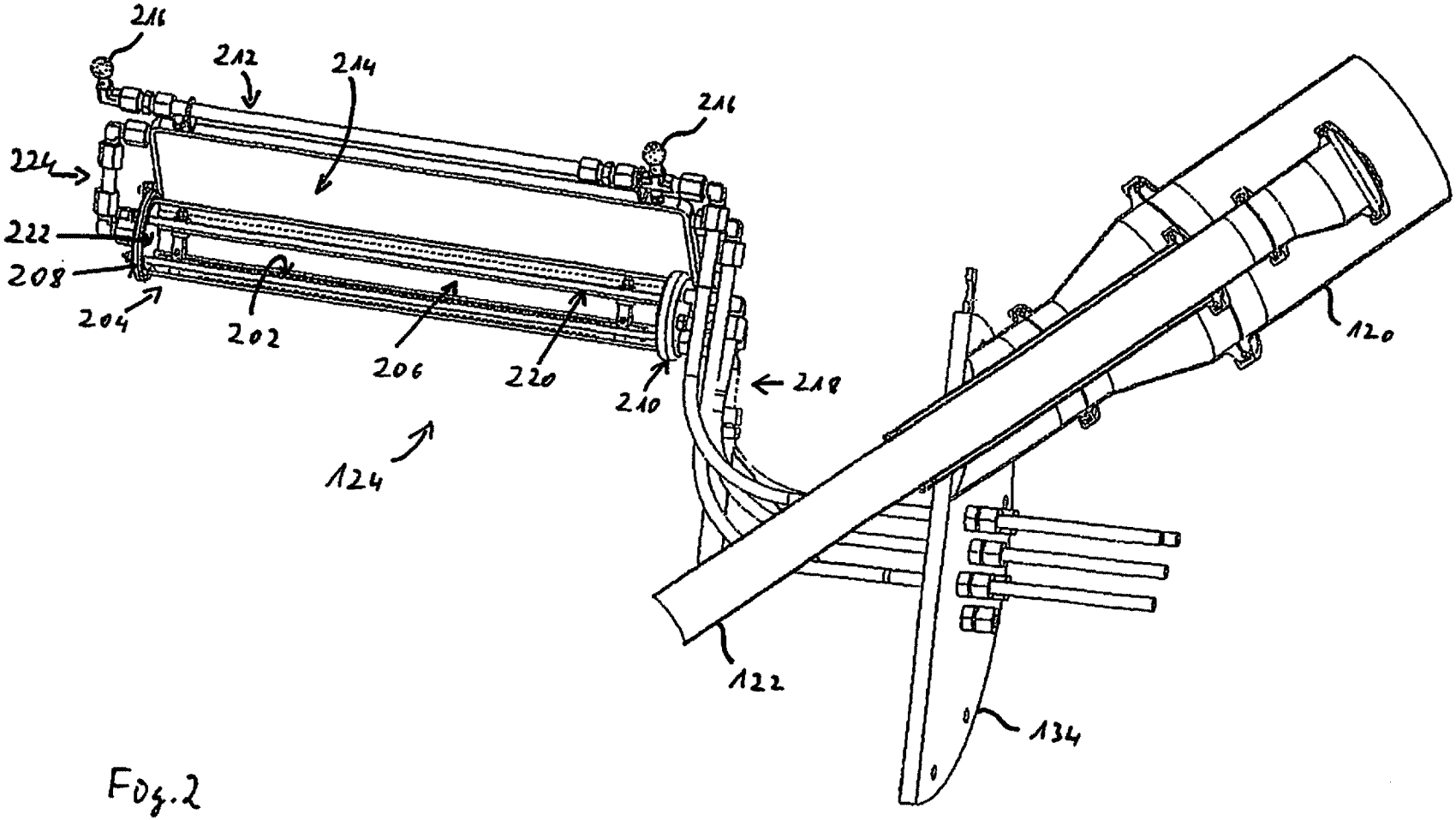
FIG. 2 is a perspective illustration of the heating device of the freeze-dryer of FIG. 1.
Figure 3:
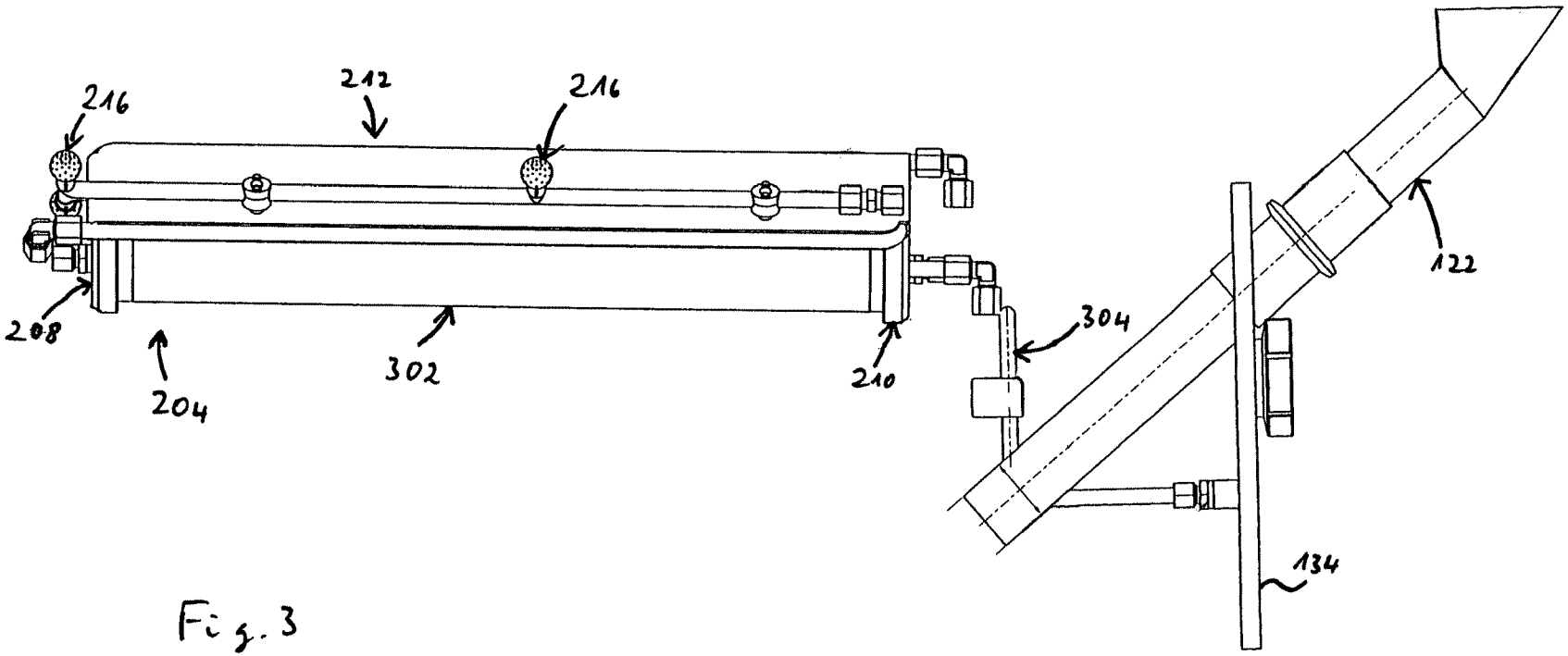
FIG. 3 is a plan view onto components of the heating device of FIG. 2.
Figure 4:
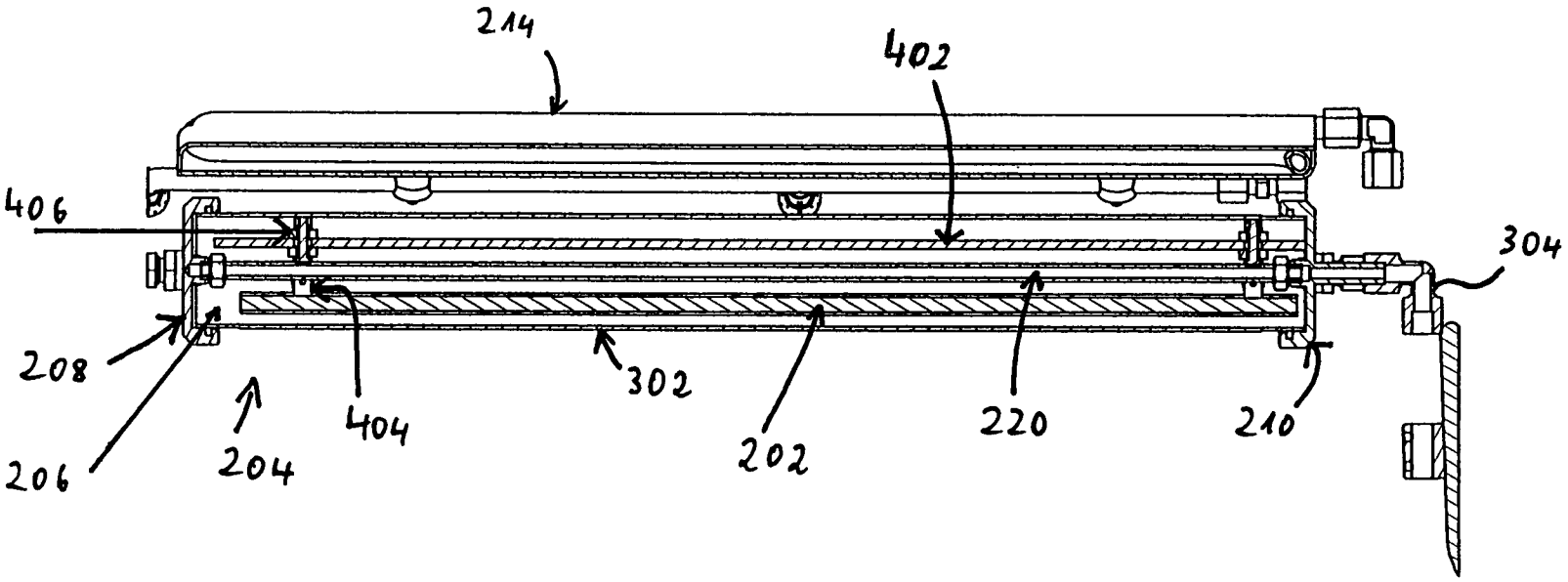
FIG. 4 is a cross-sectional view of the separator of the heating device from the preceding figures.

FIG. 2 illustrates in a perspective view the heating device 124 in further detail. FIG. 3 is a schematic plan view illustrating several components of heating device 124. It is noted that FIG. 2 illustrates a partial cross-section of transfer section 120 while FIG. 3 depicts only the guiding tube 122. FIG. 4 illustrates particular components of the heating device 124 in a cross-sectional view.

Heating device 124 comprises a radiation emitter 202 for applying radiation heat to particles 127 (cf. FIG. 1). Heating device 124 further comprises a separator 204 for separating particles 127 from emitter 202. Separator 204 comprises a glass tube 302 of generally cylindrical form. An emitter volume 206 defined inside tube 302 is further confined by flanges 208, 210, which hermetically separate drum process volume 126 and emitter volume 206 from each other. The heating device 124 further comprises covering means 212, which in turn comprises a single pitch roof 214 and carries further equipment such as cleaning/sterilization medium access nozzles 216.

The heating device 124 further comprises a supporting arm 304, which is connected to front plate 134 of vacuum chamber 104. Piping 218 is provided for: (1) supplying a cooling medium to the emitter volume 206, (2) removing the cooling medium after back flow thereof through roof 214 from the heating device 124, and (3) supplying cleaning/sterilization medium(s) to nozzles 216.

Turning to the detailed configuration of heating device 124, the glass tube 302 can be made of glass with optimized transmissivity for the radiation emitted in operation by emitter 202. Emitter 202 may be an IR emitter with maximum emissivity in the range of about 1 μm to 2 μm, and glass tube 302 can be made of quartz glass with a transmissivity of 95% or more in that wavelength range. A wall thickness of glass tube 302 is preferably selected according to maximized transmissivity as well as optimized mechanical stability.

The emitter 202 is supported inside emitter volume 206 by a flat steel bar 402 extending inside tube 302, wherein fasteners 404 for fastening emitter 202 are thermally decoupled from bar 402 via isolating means 406.

Insofar as hermetic separation is established, even if, for example, sterile conditions in process volume 126 (128, 130) are established or maintained, it is not a necessity to establish sterile conditions in emitter volume 206.

With regard to assembling flanges 208, 210 with tube 302, threadings could be provided as one option. Additionally, or alternatively, adhesive bonding can be employed, as long as any adhesive or glue used is emission-free. The explanatory example 100 illustrated in the figures implements a further solution, which can be combined with one or more of the before-mentioned options. Four steel rods 220 extend inside and along the length of the tube 302 connecting both flanges 208, 210 to each other and pulling flanges 208, 210 onto the ends of tube 302 (more or less rods of the same or a different material can be used).

However, the explanatory example 100 illustrated in the FIGS. 1 to 4 implements another solution. Four steel rods 220 extend inside and along the length of the tube 302 connecting both flanges 208, 210 to each other and pulling flanges 208, 210 onto the ends of tube 302 (more or less rods of the same or a different material can be used). The "sealing" property is understood as "leakage-free" for any gaseous, liquid and/or solid matter, to be maintained for pressure differences of, for example, atmospheric conditions in the emitter volume 206, and vacuum conditions in the drum process volume 126, wherein vacuum may mean a pressure as low as 10 mbar, or 1 mbar, or 500 μbar, or 1 μbar; and also excess pressure conditions in the drum process volume 126, which may mean a pressure as high as 1.5 bar, or 2 bar, or 3 bar, or more.

Any sealing means employed have to be able to withstand not only pressure, but also other conditions during freeze-drying, cleaning, etc., on the process volume 126 side as well as conditions on the emitter volume 206 side, for example, during operation of emitter 202; moreover, the sealing means have to seal these conditions from each other. Any sealing material should be absorption-resistant and, with exemplary regard to temperature conditions, should withstand low temperatures such as temperatures around −40° C. to −60° C. as well as high temperatures around +130° C. on the process volume 126 side, in order to avoid embrittling and/or attrition with risk of product pollution resulting therefrom.

The outer surface of glass tube 302 facing process volume 126 is cooled in order to prevent negative impact of high operating temperatures of emitter 202 on particles 127. The cooling is achieved by adapting emitter volume 206 as a cooling volume for through-conveying a cooling medium such as unsterile air, nitrogen, etc. The air, for example, can have ambient temperature, or can be cooled, depending on desired barrier or shielding properties for separator 204. Other (nonflammable) substances could also be used. The cooling medium flows inside supporting arm 304 and an inlet provided in flange 210 into the emitter/cooling volume 206, leaves volume 206 via an outlet 222 in flange 208 and backflows via pipe 224, roof 214 and one of pipes 218, and removes in this way heat from emitter 202 during an operation thereof.

In the example illustrated in FIGS. 2 to 4, the glass tube 302 is a simple straight tube with a circular cross-section, the emitter volume 206 is identical with the cooling volume, and the cooling medium streams therethrough into one direction only. However, other configurations can be contemplated. According to another example 500 illustrated in cross-section in FIG. 5A, a glass tube 502 may also have a circular outer surface 504. However, glass tube 502 comprises an internal partitioning or sub-dividing wall 506 sub-dividing the inner volume of tube 502 into an upper sub-volume or sub-tube 508 and a lower sub-volume or sub-tube 510. Such a configuration can provide high mechanical stability (and would thereby allow minimizing a wall thickness of outer walls 518 of tube 502), and provides for two sub-volumes within one tube, wherein the sub-volumes 508 and 510 may or may not be connected to each other. For example, wall 506 can have one or more openings at one or both ends of tube 500 and/or at other positions.

Various employment scenarios are contemplated. An emitter 512 can be provided in lower sub-tube 510. A cooling medium can be conveyed, for example, through lower sub-tube 510 into a forward direction, as indicated by symbol 514, and can be conveyed in a back direction (symbol 516) through upper sub-tube 508. Accordingly, equipment otherwise required for back-flow of the cooling medium can be saved, wherein such equipment would have to be arranged external to tube 502, e.g. in a process volume, and therefore saving such equipment is beneficial, and can contribute to simplifying a design of the heating device and/or a cleaning/sterilization of those parts of the heating device facing a drum process volume.

According to other examples, the upper sub-volume 508 may not be used for guiding any cooling medium, but can be designed as a closed volume, which can be, for example, evacuated in order to serve as an isolation volume for (passively) isolating emitter volume 510 against a surrounding drum process volume 520.

Figure 5B:
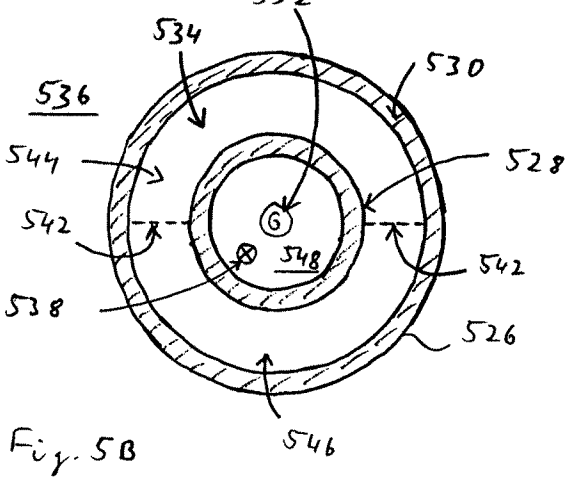

Another example of a glass tube 526 is illustrated in FIG. 5B. An inner sub-volume or sub-tube 528 is encompassed by and extends inside an outer tube 530, wherein tubes 528, 530 are concentrically arranged to each other. In this example, an emitter 532 is arranged inside tube 528. The annular space 534 defined between inner 528 and outer 530 tube can be utilized as isolation volume. For example, volume 534 can be evacuated in order to isolate a surrounding drum process volume 536 from the potentially high operating temperatures of emitter 532. According to the example illustrated in FIG. 5B, a cooling medium is guided along a forward direction 538 via inner tube 528. The cooling medium has to be externally guided out of the corresponding heating device, as long as the annular space 534 is used only as isolation volume. According to another alternative, the cooling medium could be conveyed in a backward direction via volume 534.

A variation of the example of FIG. 5B is illustrated with dashed lines 542 intended to indicate that annular space 534 can be sub-divided (by inner walls 542) into an upper sub-volume 544 and a lower sub-volume 546. According to one example, a cooling medium could, for example, be guided into a forward direction along sub-volume 546 and in a backward direction along sub-volume 544. Other configurations utilizing one or more of sub-volumes 548, 544 and 546 for guiding a cooling medium therethrough in one or more directions can be contemplated. According to one particular example, the sub-volume 548 can be closed with, for example, atmospheric pressure conditions, while a cooling medium is guided via sub-volumes 544 and 546 for removing heat flow via walls of tube 528 resulting from an operation of emitter 532.

While in the configuration of FIG. 5B, upper and lower annular spaces 544 and 546 are illustrated with similar and rotation-symmetric cross-sections, other examples can have a different configuration. For example, an annular space may have an angular variation in width. Additionally, or alternatively, an upper and lower annular space may not necessarily be symmetrically formed. Still further, while sub-dividing walls 506, 542 extend horizontally in FIGS. 5A, and 5B, respectively, other configurations can be contemplated, wherein deviations from a strictly horizontal orientation can for example be selected according to a direction of an emitter radiation to be incident on the (batch) product to be heated.

Figure 5D:
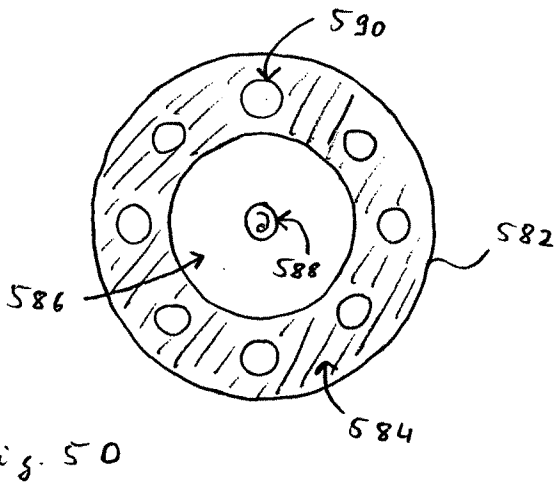
Figure 5A:
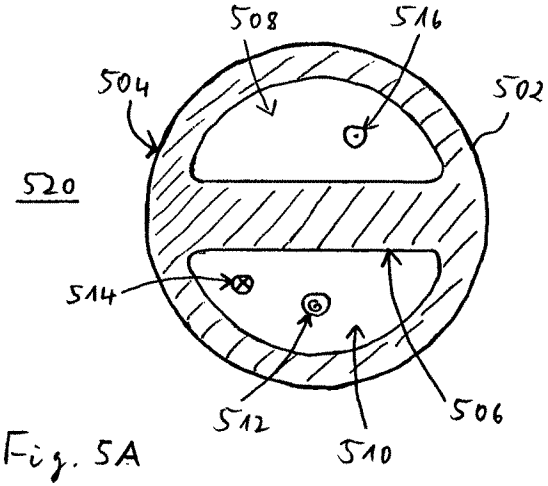
Figure 5C:
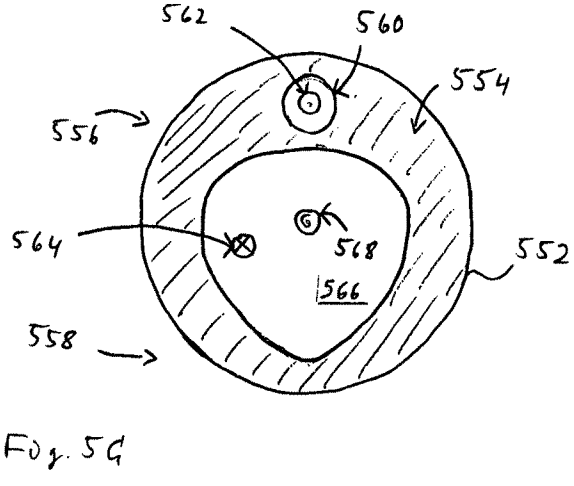

FIG. 5C illustrates another configuration, wherein a tube 552 with an outer circular cross-section comprises wall 554 with a varying wall thickness. Specifically, an upper portion 556 of tube 552 has larger thickness, while thickness decreases towards a lower portion 558. A capillary tube 560 is illustrated which can be used, for example, for guiding a cooling medium therethrough to cool upper portion 556 of tube 552 and thereby remove heat. In the configuration illustrated in FIG. 5C, the cooling medium is guided in a forward direction 562 through tube 560 and in a backward direction 564 through emitter volume 566 comprising emitter 568. Other options for conveying a cooling medium through one or both of tubes/volumes 560, 566 are contemplated and within the routine design variations.

FIG. 5D illustrates a still further configuration. A tube 582 with circular perimeter comprises wall 584 confining emitter volume 586 which receives emitter 588. A plurality of capillary tubes 590 are embedded within wall 584. A cooling medium (e.g., a cooling liquid) can be conveyed through one or more of the capillary tubes 560 into a forward and/or a backward direction for removing operational heat of emitter 558. Additionally, or alternatively, a cooling medium can be conveyed via emitter volume 586. While capillary tubes 560 are arranged in a regular pattern within wall 554, according to other configurations, capillary tubes can be grouped, for example, to be preferably located in an upper portion of a tube wall.

The tube configurations illustrated herein may additionally comprise reflecting means such as, for example, reflecting layers, such that the emitter radiation can be preferably directed to be incident on the product.

Referring back to the heating device 124 illustrated in FIGS. 2 to 4, roof 214 is intended to cover separator 204 from the top. In this way, particles traversing drum process volume 126 (cf. FIG. 1) from top to bottom can be redirected away from glass tube 302. Provision of roof 214 may loosen the cooling requirements for the separator 204, more precisely, the requirements for a maximum temperature allowable for the surface of glass tube 302 facing the drum process volume.

Roof 214 has been implemented as single pitch roof, as this and similar types of covers are particularly suited for easy cleaning/sterilization within CiP/SiP concepts. Cleaning/sterilization medium access points 216 are adapted for supplying cleaning/sterilization medium for cleaning/sterilizing the heating device 124 as well as the interior of rotary drum 102. In this respect, nozzles 216 are positioned in exposed positions, on top of covering means 212.

While covering means 212 is shown spaced apart from other components of heating device 124 (such as separator 204 including glass tube 302), according to other configurations, a covering means can be in immediate contact with, for example, a separator component such as a glass tube confining an emitter volume. According to one example, a covering means can be formed as an arched roof, optionally including a cooling mechanism for cooling the roof. Such covering means could at the same time function as a reflecting means for directing radiation from the emitter into desired directions.

With exemplary reference to the explanatory example illustrated in FIGS. 1 to 4, each of the following ensembles can be contemplated as a trade unit. The heating device 124, with or without the supporting arm 304 (in mounted or dismounted state), with or without the front plate 134 (in mounted or dismounted state), and with or without transfer section 120 (in mounted or dismounted state); the separator 204 including glass tube 302 and flanges 208, 210 with or without internal equipment such as emitter 202; and/or the glass tube 302 with or without emitter 202.

In the following, a preferred embodiment of a heating device according to the invention is described on the basis of FIGS. 6 to 9C. Here, it is to be noted that the surroundings as well as additional components or similar components of the above described explanatory example of a heating device also apply for the below described preferred embodiment of a heating device according to the invention, where appropriate, and a detailed description of the same is, thus, omitted in order to prevent redundancy. However, where applicable, descriptions from the explanatory example can be adopted to the preferred embodiment as described below. In particular, the preferred embodiment of the heating device as described in the following is applicable in the freeze-dryer as shown in FIG. 1 and described in the respective parts above.

FIG. 6 is a sectional illustration (along the longitudinal axis) of a preferred embodiment of a heating device 624 in accordance with the invention. In this illustration, heating device 624 is attached to front plate 134 of vacuum chamber 104. Piping 718 similar to piping 218 in FIG. 1 is provided for: (1) supplying a cooling medium to an emitter volume 706 by a cooling supply tube 718*a*, (2) removing the cooling medium after back flow thereof through cooling exhaust tube 718*b*, and optionally (3) supplying cleaning/sterilization medium(s) to respective optional nozzles (not shown) outside emitter volume 706.

Heating device 624 further comprises a separator 704 for separating particles 127 from two radiation emitters 702. Dome- or beam-shaped separator 704 consists of an elongated glass tube of generally cylindrical form, wherein the particular shape of the glass tube provides improved stability of separator 704 against high pressure, such as high pressure during sterilization. Emitter volume 706 defined inside separator 704 is further confined by closed free end 704*a* of separator 704 and a support plate 725, which separate drum process volume 126 and emitter volume 706 from each other. The heating device 624 optionally carries further equipment such as cleaning/sterilization medium access nozzles (not shown), similar to the explanatory example of FIGS. 1 to 4.

Turning to the detailed configuration of heating device 624, the glass tube can be made of glass with optimized transmissivity for the radiation emitted in operation by emitters 702. According to various configurations, each emitter 702 may be an IR emitter with maximum emissivity in the range of about 1 μm to 2 μm, and separator 704 can be made of quartz glass with a transmissivity of 95% or more in that wavelength range. A wall thickness of the glass tube is preferably selected according to maximized transmissivity as well as optimized mechanical stability.

As can be gathered from FIG. 6, separator 704, or better its free end 704*a*, is protruding into drum process volume 126, wherein the other end or base end 704*b* of the glass tube of separator 704 is held within a multi-component socket structure in a way such that separator 704 is held in a rotatable manner around its longitudinal axis. Thus, in a cantilevered way, heating device 624 is placed freely inside process volume 126 without the need of a mounting of end 704*a* of separator 704 of heating device 624 inside process volume 126, thereby making it possible in case of a failure of the heating device 624 during the freeze-drying process to exchange the heating device 624 easily.

As to the particular structure of separator 704 of the preferred embodiment, base end 704*b* of separator 704 comprises an integrally provided rim-like ledge 705 at its end face, which ledge 705 protrudes radially outside from the main body of the glass tube of separator 704. In particular, as can be seen in enlarged detail in FIG. 78, base end 704*b* of separator 704, especially above the separator ledge 705, is held inside a cylindrical isolator sleeve 730, the sleeve 730 preferably consisting at least in part of Polyoxymethylene (POM), which prohibits a direct contact between the glass tube of separator 704 and metal components of the socket structure in order to ensure tightness of heating device 624 in view of differing thermal expansion coefficients of the different structural components of heating device 624, isolator sleeve 730 is preferably fixed on the outside of the glass tube of separator 704 by means of silicone glue or the like, in order to tightly attach sleeve 730 with the separator 704 and to provide tightness in between those components. Further, Isolator sleeve 730 is arranged inside a cylindrical bushing 750, preferably made of stainless steel, with a gap in between sleeve 730 and bushing 750. Here, compensation O-rings 735, preferably consisting of silicone or ethylene propylene diene monomer (EPDM) rubber, are arranged in respective recesses in the outer circumference of sleeve 730, wherein bushing 750 is in contact with compensation O-rings 735 on its inner circumference. Compensation O-rings 735 serve for temperature-compensation in between the components of the socket structure. With this particular structure, it is possible to avoid one of the problems occurring with heating devices as known from prior art, namely undesired exchange of ambient conditions between the inside of heating device 624 and the outside, i.e. the inside of drum 102, also referred to as leakage, which occurs between the different structural components of a heating device due to the different thermal expansion coefficients of the different structural components (metal, glass, etc.) of heating devices as known from prior art. In the preferred embodiment, on the other hand, the glass tube of separator 704 is thermally decoupled from any metal components of the heating device 624, thereby enhancing the ability to prevent leakage between the emitter volume 706 and the drum process volume 126.

The bushing 750 is arranged inside a cylindrical hull 760, preferably made of stainless steel, the open end of hull 760 facing the closed free end 704*a* of separator 704 is closed by a cup-shaped lid 770, preferably made of stainless steel. Here, bushing 750 is held inside lid 770 in tight contact with the inner circumference of lid 770. The free end 704*a* penetrates lid 770 through an opening in lid 770 such that free end 704*a* can protrude into drum process volume 126. In order to seal the socket structure, and thereby the emitter volume 706 in view of drum process volume 126 hermetically, sealing O-ring 740*a*, preferably consisting of silicone or ethylene propylene diene monomer (EPDM) rubber, is arranged in between lid 770 and an end face of isolator sleeve 730. Further, in order to further seal the socket structure, sealing O-rings 740*b*, preferably consisting of silicone or ethylene propylene diene monomer (EPDM) rubber, are arranged in between the other end face of isolator sleeve 730 and separator ledge 705, and in between separator ledge 705 and a disc-shaped plate 751, respectively, plate 751 preferably made of stainless steel and serving as a cover for bushing 750, wherein plate 751 is in contact with the other end of bushing 750 opposite to the end of bushing 750 being closed by lid 770. Any sealing means employed have to be able to withstand not only pressure, but also other conditions during freeze-drying, cleaning, etc., on the process volume 126 side as well as conditions on the emitter volume 706 side, for example, during operation of emitters 702; moreover, the sealing means have to seal these conditions from each other. Any sealing material should be absorption-resistant and, with exemplary regard to temperature conditions, should withstand low temperatures such as temperatures around −40° C. to −60° C. as well as high temperatures around +130° C. on the process volume 126 side, in order to avoid embrittling and/or attrition with risk of product pollution resulting therefrom.

With this particularly interlaced structure as described above, heating device 624 provides a kind of "outer shell" being exposed to the drum process volume 126, which outer shell basically consists of separator 704, lid 770 (together with sealing O-ring 740*a* arranged on the side of separator's closed end), hull 760 and front plate 134. The remaining parts of heating device 624 are basically arranged inside the vacuum-tight outer shell with the main heat generating equipment being arranged thereinside, which enables that the heating device 624 can be maintained arranged inside drum process volume 126 and that the vacuum inside drum 102 or housing chamber 104 during freeze-drying can be kept intact, while it is possible to exchange one or all of emitters 702 in case of occurrence of emitter failure or failure of any other component arranged inside the outer shell. With this particular interlaced structure of heating device 624, during occurrence of emitter failure, the product to be freeze-dried can be kept inside drum 102 along with substantially maintaining desired process conditions while one or several of damaged emitters 702 can be exchanged, thereby prohibiting generation of waste product due to discontinuance of process conditions.

In the preferred embodiment, plate 751 comprises a central opening, in which one end of a cylindrical carrier sleeve 752, preferably made of stainless steel, is arranged in an attached manner in that the outer circumference of carrier sleeve 752 is in contact with the inner circumference of the opening in plate 751, thereby carrying plate 751. The other end of carrier sleeve 752 is arranged inside an opening of a cover plate 780, preferably made of stainless steel, which cover plate 780 is attached to front plate 134 of vacuum chamber 104. In order to be able to compensate a length expansion of the glass tube of separator 704 due to high temperature, cover plate 780 is attached to front plate 134 by means of bolts 781 and spring discs 782.

Piping 718, i.e. its tubes as well as an electro supply pipe 790 are guided through the inner space of carrier sleeve 752 into the socket structure by means of one or several (arranged in series) pot-shaped assemblies consisting of a cylindrical inner shell 726, preferably made of POM or Polytetrafluoroethylene (PTFE) and guiding the glass tube along with preventing any kind of scratching the same, and support plate 725 which closes one end of inner shell 726 on the side of the free end 704*a* of separator 704, wherein support plate 725 is attached to inner shell 726 by a screw-connection or the like. Here, the tubes of piping 718 and electro supply pipe 790 are welded into support plate 725, which is preferably made of stainless steel. Further, the glass tube of separator 704 is held from its inside by one or several of the above described pot-shaped structures. With such a construction, the glass tube of separator 704 is sandwiched in between inner shell 726 and isolator sleeve 730, wherein ledge 705 is held in an axial direction in between a pack of two sealing O-rings 740*b*, the pack of sealing O-rings 740*b* being held in between isolator sleeve 730 and plate 751, and in a radial direction from the outside by means of bushing 750. Attached to cover plate 780 by means of a mounting panel 741, electro supply pipe 790 penetrates through cover plate 751, front plate 134, and the socket structure of separator 704, wherein the free end of pipe 790 directed towards free end 704*a* of separator 704 is attached to support plate 725. Here, pipe 790 guides electrical wiring to emitters 702 and is attached to mounting panel 741 by means of a thermo screw connection 791, i.e. a self cutting screw union connection with a cutting ring or compression ring being made of POM. With such a screw connection, it is possible to adjust the rotational angle of separator 704 around its longitudinal axis as desired, stabilized by mounting panel 741.

Inside the socket structure, as can be gathered from FIGS. 1, 7A, 7B, 8A and 8B, cooling supply tube 718*a* penetrates support plate 725 and is connected to a rectangular cooling duct 720 provided with cooling openings 721 for guiding cooling fluid to the upper interior of separator 704 opposite the two emitters 702, i.e. emitter volume 706. As can be seen in detail in FIGS. 8A and 8B, rectangular duct 720 is arranged inside separator 704 in a way such that, in the figures, the corners of the rectangular shape are aligned with the vertical and horizontal plane. The inner surface of separator 704 facing process volume 126, and thereby the separator 704 itself, is cooled by the guided cooling fluid in order to prevent negative impact of high operating temperatures of emitters 702 on particles 127. The cooling is achieved by adapting emitter volume 706 as a cooling volume for through-conveying a cooling medium such as unsterile air, nitrogen, etc. The air, for example, can have ambient temperature, or can be cooled, depending on desired barrier or shielding properties for separator 704. Other (nonflammable) substances could also be used. The cooling medium flows inside cooling supply tube 718*a* to duct 720, is released through openings 721 into emitter volume 706 and leaves volume 706 via cooling exhaust tube 718*b*, and removes in this way heat from emitters 702 during an operation thereof.

On the upper sides of duct 720, a protection roof 710, preferably made of PTFE, is attached, which roof 710 serves as a reflecting means and can consists of two separate rails each forming one slope of the roof structure, as can be seen in FIGS. 8A and 8B, or can alternatively consists of one single component, for example a buckled plate or the like. Roof 710 covers emitters 702 arranged in a mirror-inverted way below roof 710 in a way such that roof 710 shields or insulates the upper part of separator 704 from the heat generated by emitters 702. Thereby, heat generated by emitters 702 can be directed by means of roof 710. Emitters 702 are also attached to duct 720, similarly to roof 710, wherein mounting means 703 for each emitter 702 are provided in a way such that emitters 702 are held in a free manner inside the glass tube of separator 704 without direct contact of any one of emitters 702 with duct 720, roof 710 or the glass tube of separator 704. The mounting means of each emitter 702 basically consist of a bracket attached to the double-barrel-shaped emitter 702, which bracket is screwed to a flange attached to a lower side face of duct 720.

As can be seen in FIGS. 9A and 9B, separator 704, more specifically free end 704*a* of separator 704 is held in a cantilevered, rotatable way inside the socket structure as described above. Here again, as well as from FIG. 9C, it can be gathered that opening 116 of drum 102 is adapted for loading the drum 102 with particles via a transfer section 120 comprising an interior guiding tube 122 for guiding a product flow from an upstream particle storage/container and/or particle generation device (such as a spray chamber, prilling tower, and the like) into drum 102. Guiding tube 122 penetrates an opening 135 in front plate 134 for loading particles 127 into drum 102.

With such a structure of the heating device 624 of the invention, the only material exposed to process volume 126 is the glass tube of separator 704. Thus, since no mix of materials is exposed to process volume 126, no leakage issues due to different heat expansion coefficients. Furthermore, due to the use of a monomaterial, i.e. the glass of separator 704, heating device 624 has a crevice-free design and, thus, exhibits an improved cleanability.

The heating device(s) such as discussed herein can beneficially be employed for freeze-drying of, for example, sterile free-flowing frozen particles as bulkware. Embodiments of the invention can be employed in design concepts related to a production under sterile conditions and/or containment conditions. A substantial energy input as required for performing lyophilization on timescales shorter than available with conventional approaches can be provided by heating devices according to the invention employing radiation emitters. Undesired "hot spots" (points of local overheating) in contact with the process volume and therefore representing potential hazard for the particles to be freeze-dried can be eliminated by providing a separator around the emitter which can be adapted to not only separate the particles from the radiation emitter, but to also provide a barrier for any temperature "hot spot" resulting from the high-operating temperatures of the emitter.

Further, the emitter volume (and/or isolation volume) provided by heating devices according to the invention can be configured to be excluded from the process volume inside the drum, such that drawbacks can be avoided such as difficult cleaning/sterilization conditions, pollution, complex cooling based on demands for a sterile cooling medium, etc. Embodiments of heating devices according to the invention are particularly suited for cost-efficient freeze-dryer design. Embodiments of heating devices according to the invention can contribute to providing simplified freeze-dryer designs. According to the preferred embodiment, a drum design can potentially be simplified as heating via an inner drum wall surface may no longer be required.

Embodiments of freeze-dryers equipped with heating devices according to the invention can be employed for the generation of sterile, lyophilized, uniformly calibrated particles as bulkware. The resulting products can comprise virtually any formulation in liquid or flowable paste state that is suitable also for conventional (e.g., shelf-type) freeze-drying processes, for example, monoclonal antibodies, protein-based APIs, DNA-based APIs, cell/tissue substances, human and animal vaccines and therapeutics, APIs for oral solid dosage forms such as APIs with low solubility/bioavailability; fast dispersible oral solid dosage forms like ODTs (orally dispersible tablets), stick-filled adaptations, etc., as well as various products in the fine chemicals and food products industries. In general, suitable flowable materials include compositions that are amenable to the benefits of the freeze-drying process (e.g., increased stability once freeze-dried).

While the current invention has been described in relation to a preferred embodiment thereof, it is to be understood that this description is for illustrative purposes only.

This application claims priority of European patent application EP 11 008 108.0-1266, the subject-matters of the claims of which are listed below for the sake of completeness:

1. A heating device for heating particles to be freeze-dried in a rotary drum of a freeze-dryer, the device comprising
   - a radiation emitter for applying radiation heat to the particles; and
   - a separator for separating the particles from the emitter, wherein the separator forms an emitter volume for encompassing the emitter, and the separator is adapted to separate the emitter volume from a drum process volume inside the drum.

2. The heating device according to item 1, wherein the separator is at least in part transmissive for the emitter radiation to enter the drum process volume.

3. The heating device according to items 1 or 2, wherein the emitter volume is hermetically separated from the drum process volume, and the hermetic separation is provided for at least one of vacuum pressure conditions and excess pressure conditions in the drum process volume.

4. The heating device according to any one of the preceding items, wherein the separator comprises a glass tube.

5. The heating device according to any one of the preceding items, further comprising a cooling mechanism for cooling at least a surface of the heating device facing the drum process volume.

6. The heating device according to item 5, wherein the cooling mechanism comprises a cooling volume for through-conveying a cooling medium.

7. The heating device according to item 6, wherein the cooling volume comprises the emitter volume.

8. The heating device according to any one of preceding items, wherein the separator comprises an isolation volume.

9. The heating device according to any one of the preceding items, wherein the separator comprises a tube including two or more sub-tubes extending at least in part in parallel along the length of the tube.

10. The heating device according to any one of the preceding items, further comprising a covering means covering the emitter volume at least in part on the top.

11. The heating device according to item 10, further comprising a cooling mechanism for cooling at least an upper surface of the covering means.

12. A separator for separating particles to be freeze-dried in a rotary drum of a freeze-dryer from a radiation emitter for applying radiation heat to the particles, wherein the separator forms an emitter volume for encompassing the emitter, and the separator is adapted to separate the emitter volume from a drum process volume inside the drum.

13. The separator according to item 12, wherein the separator comprises a glass tube with a circular cross-section, and each end of the glass tube is closed by a flange hermetically sealing the emitter volume defined inside the tube against the drum process volume.

14. A wall section of a rotary drum freeze-dryer for the bulkware production of freeze-dried particles, the section comprising a heating device for heating the particles to be freeze-dried in the rotary drum of the freeze-dryer according to any one of items 1 to 11.

15. A freeze-dryer comprising a wall section according to item 14.

The invention claimed is:

1. A separator for separating particles to be freeze-dried in a rotary drum of a freeze-dryer from at least one radiation emitter for applying radiation heat to the particles, the separator having a first end extending into the drum via an opening in the drum, said separator being integrally closed at said first end and sealed at a second end by a socket structure, wherein the separator comprises a glass tube; and
   - a sleeve circumferentially disposed around and fixed on a portion of said separator, said socket structure comprising:
     - a cover plate; and
     - an outer shell including:
       - a cylindrical outer hull surrounding said separator second end, said hull extending from a second end at said cover plate into the drum, said hull disposed radially outward relative to said sleeve;
       - a lid arranged as a cover on a first end of said hull;
       - a sealing O-ring arranged between said lid and said sleeve, wherein said sealing O-ring seals a first end of said socket structure, between said lid and said sleeve; and
       - a front plate of said freeze dryer-seal defined by and located radially outwardly relative to said hull.

2. A rotary drum having a drum process volume for heating particles to be freeze-dried in a freeze-dryer, the rotary drum being in a vacuum chamber, comprising:
   - a heating device including at least one radiation emitter for applying radiation heat to the particles, said heating device extending at least partly into said drum via an opening in said drum;

a tube-shaped separator for separating the particles from the at least one emitter, said separator forming an emitter volume for encompassing said emitter, the separator having a first end extending into said drum via said opening in said drum, said separator being integrally closed at said first end and sealed at a second end by a socket structure; and a sleeve circumferentially disposed around and fixed on a portion of said separator, said socket structure comprising:

a cover plate; and an outer shell including:

a cylindrical outer hull surrounding said separator second end, said hull extending from a second end at said cover plate into said drum, said hull disposed radially outward relative to said sleeve;

a lid arranged as a cover on a first end of said hull;

a sealing O-ring arranged between said lid and said sleeve, wherein said sealing O-ring seals a first end of said socket structure, between said lid and said sleeve; and a front plate of said vacuum chamber located radially outwardly relative to said hull.

3. The rotary drum according to claim 2, wherein said sleeve is fixed on said portion of said separator by gluing.

4. The rotary drum according to claim 2, wherein the heating device is adapted to be held rotatable inside the drum process volume.

5. The rotary drum according to claim 2, wherein a hermetic separation is provided for at least one of vacuum pressure conditions and excess pressure conditions in the drum process volume.

6. The rotary drum according to claim 2, wherein the separator comprises an isolation volume.

7. The rotary drum according to claim 2, wherein said cover plate is positioned on the outside of said vacuum chamber, said cover plate defining an opening coinciding with said drum opening, said socket structure extending into said drum via said cover plate opening.

8. The rotary drum according to claim 2, wherein said socket structure includes a rotatable seal having temperature-compensating O-rings between said hull and said sleeve.

9. The rotary drum according to claim 2, said socket structure further including a disc-shaped plate, said separator second end including a ledge configured to seal against said disc-shaped plate.

10. The rotary drum according to claim 2, wherein an elongate pipe extends through said socket structure and penetrates through said cover plate, said elongate pipe attached to a panel attached to the vacuum chamber by means of a connection, said connection configured to allow adjustment of a rotational angle of said separator around a separator longitudinal axis.

11. The rotary drum according to claim 2, said socket structure further including a bushing located between said hull and said sleeve, said bushing configured to retain a ledge of said separator second end in a radial direction.

12. The rotary drum according to claim 11, wherein said socket structure further includes:

a disc-shaped plate configured to serve as a cover at a second end of said bushing; and sealing O-rings between a second end of said sleeve and said ledge and between said ledge and said disc-shaped plate, wherein said sealing O-rings seal a second end of said socket structure.

13. The rotary drum according to claim 2, wherein a reflecting means is provided inside the separator for directing the radiation heat generated by the emitter.

14. The rotary drum according to claim 13, wherein the reflecting means is at least partly covering the emitter.

15. The rotary drum according to claim 2, wherein two emitters are provided inside the separator.

16. The rotary drum according to claim 15, wherein the two emitters are provided in the form of a mirror-symmetric arrangement.

17. The rotary drum according to claim 2, further comprising a covering means covering said emitter volume at least in part on the top.

18. The rotary drum according to claim 17, further comprising a cooling mechanism for cooling at least an upper surface of the covering means.

19. The rotary drum according to claim 2, wherein the separator is at least in part transmissive for the emitter radiation to enter the drum process volume.

20. The rotary drum according to claim 19, wherein the separator is made at least in part of glass material.

21. The rotary drum according to claim 20, wherein the separator comprises a glass tube.

22. The rotary drum according to claim 2, further comprising a cooling mechanism for cooling at least a surface of the heating device facing the drum process volume.

23. The rotary drum according to claim 22, wherein the cooling mechanism comprises a cooling volume for through-conveying a cooling medium.

24. The rotary drum according to claim 23, wherein the cooling volume includes said emitter volume.

25. A rotary drum having a drum process volume for heating particles to be freeze-dried in a freeze-dryer, the rotary drum being in a vacuum chamber, comprising:

a heating device including at least one radiation emitter for applying radiation heat to the particles, said heating device extending at least partly into said drum via an opening in said drum;

a tube-shaped separator for separating the particles from the at least one emitter, said separator forming an emitter volume for encompassing said emitter, the separator having a first end extending into said drum via said opening in said drum, said separator being integrally closed at said first end and sealed at a second end by a socket structure; and a sleeve circumferentially disposed around and fixed on a portion of said separator, said socket structure comprising:

a cover plate;

an outer shell including:

a cylindrical outer hull surrounding said separator second end, said hull extending from a second end at said cover plate into said drum, said hull disposed radially outward relative to said sleeve;

a lid arranged as a cover on a first end of said hull; and a front plate of said vacuum chamber located radially outwardly relative to said hull; and a disc-shaped plate, said separator second end including a ledge configured to seal against said disc-shaped plate.

26. A rotary drum having a drum process volume for heating particles to be freeze-dried in a freeze-dryer, the rotary drum being in a vacuum chamber, comprising:

a heating device including at least one radiation emitter for applying radiation heat to the particles, said heating device extending at least partly into said drum via an opening in said drum;

a tube-shaped separator for separating the particles from the at least one emitter, said separator forming an emitter volume for encompassing said emitter, the separator having a first end extending into said drum via said opening in said drum, said separator being integrally closed at said first end and sealed at a second end by a socket structure; and a sleeve circumferentially disposed around and fixed on a portion of said separator, said socket structure comprising:

a cover plate;

an outer shell including:

a cylindrical outer hull surrounding said separator second end, said hull extending from a second end at said cover plate into said drum, said hull disposed radially outward relative to said sleeve;

a lid arranged as a cover on a first end of said hull; and a front plate of said vacuum chamber located radially outwardly relative to said hull; and a bushing located between said hull and said sleeve, said bushing configured to retain a ledge of said separator second end in a radial direction.

27. A rotary drum according to claim 26, wherein said socket structure further includes:

a disc-shaped plate configured to serve as a cover at a second end of said bushing; and sealing O-rings between a second end of said sleeve and said ledge and between said ledge and said disc-shaped plate, wherein said sealing O-rings seal a second end of said socket structure.

* * * * *